US012616256B1

(12) United States Patent
Eichenberger et al.

(10) Patent No.: US 12,616,256 B1
(45) Date of Patent: May 5, 2026

(54) BREAST SUPPORT GARMENT

(71) Applicants: Robert H. Eichenberger, Lanesville, IN (US); Cindy M. Eichenberger, Lanesville, IN (US)

(72) Inventors: Robert H. Eichenberger, Lanesville, IN (US); Cindy M. Eichenberger, Lanesville, IN (US)

(73) Assignee: CERE Creations, LLC, Lanesville, IN (US)

( * ) Notice: Subject to any disclaimer, the term of this patent is extended or adjusted under 35 U.S.C. 154(b) by 0 days.

(21) Appl. No.: 19/077,975

(22) Filed: Mar. 12, 2025

Related U.S. Application Data

(60) Provisional application No. 63/564,209, filed on Mar. 12, 2024.

(51) Int. Cl.
*A41C 3/12* (2006.01)
*A41C 3/00* (2006.01)

(52) U.S. Cl.
CPC ..... *A41C 3/128* (2013.01); *A41C 3/0064* (2013.01)

(58) Field of Classification Search
CPC ..... A41C 3/0064; A41C 3/128
See application file for complete search history.

(56) References Cited

U.S. PATENT DOCUMENTS 2,374,093 A * 4/1945 Gluckin ..... A41C 3/0021 450/59
2,427,402 A * 9/1947 Gluckin ..... A41C 3/0021 450/59
2,607,038 A * 8/1952 Spare ..... A41C 3/0021 450/59
2,637,851 A 5/1953 Peck
2,883,225 A * 4/1959 Akehurst ..... E05D 13/08 292/DIG. 20
3,200,821 A * 8/1965 Anderson ..... A41C 3/0028 2/73
3,221,748 A * 12/1965 Glasser ..... A41C 3/10 D2/706

(Continued)

FOREIGN PATENT DOCUMENTS

CA 2852017 C 1/2020
DE 202009005440 U1 7/2009

(Continued)

*Primary Examiner* — Gloria M Hale
(74) *Attorney, Agent, or Firm* — Dinsmore & Shohl LLP

(57) ABSTRACT

A support garment for providing targeted, localized compression in a medial, medial-caudal, or medial-cephalad direction to the breasts of a wearer. The garment includes cups for receiving breasts of a user, a rear panel, and left and right wings connecting the left and right cups to a rear panel. The wings can contain a pocket therein for receiving a pad through a pocket opening in the wings. The pads, when present within the pockets, provide localized, targeted compression in a medial and/or medial-caudal and/or medial cephalad direction to the breasts. Medial compressors including one or more straps also, or alternatively, provide targeted compression in a medial and/or medial-caudal and/or medial-cephalad direction to the breasts. Alternatively, a removable sleeve having an inner pouch with a pad therein can be provided to attach to any garment to provide desired targeted, localized compression to the breasts.

14 Claims, 15 Drawing Sheets

(56) References Cited

U.S. PATENT DOCUMENTS

| | | | | |
|---|---|---|---|---|
| 3,459,190 | A * | 8/1969 | Frischer | A41C 3/02 450/59 |
| 3,950,792 | A | 4/1976 | Williams | |
| 4,369,792 | A | 1/1983 | Miller | |
| 4,674,510 | A * | 6/1987 | Sneider | A61F 13/145 450/57 |
| 4,699,144 | A * | 10/1987 | Sherwood | A41C 3/148 450/54 |
| 5,098,330 | A * | 3/1992 | Greenberg | A41C 3/10 450/55 |
| 5,158,541 | A | 10/1992 | McCurley | |
| 5,797,787 | A | 8/1998 | Kaye | |
| 6,165,045 | A | 12/2000 | Miller et al. | |
| 6,390,885 | B1 | 5/2002 | Brooks | |
| 6,394,879 | B1 * | 5/2002 | Paige | A41C 3/04 450/38 |
| 6,443,805 | B1 | 9/2002 | Kirkwood | |
| 7,909,675 | B1 | 3/2011 | Rainey | |
| 8,840,442 | B2 * | 9/2014 | Linkon | A41C 3/10 450/36 |
| 8,840,443 | B2 | 9/2014 | Kadium | |
| 8,858,295 | B2 | 10/2014 | Thompson | |
| 9,192,197 | B2 | 11/2015 | Reinhard | |
| 9,681,692 | B2 | 6/2017 | Hansen | |
| 10,357,065 | B2 | 7/2019 | Donlon et al. | |
| 10,986,880 | B2 | 4/2021 | Stephens et al. | |
| 11,311,057 | B2 | 4/2022 | Nogawa et al. | |
| 11,864,598 | B2 * | 1/2024 | Greenwood | A41C 3/10 |
| 2002/0102913 | A1 * | 8/2002 | Courtney | A41C 3/02 450/57 |
| 2011/0041231 | A1 | 2/2011 | Behrens et al. | |
| 2012/0021669 | A1 | 1/2012 | Johnstone | |
| 2012/0028541 | A1 * | 2/2012 | Donnelly | A41C 3/0021 450/86 |
| 2013/0065486 | A1 | 3/2013 | Hansen | |
| 2013/0065489 | A1 * | 3/2013 | Bultez | B24B 13/0012 451/8 |
| 2013/0122780 | A1 | 5/2013 | McCall | |
| 2015/0011140 | A1 | 1/2015 | Gorski et al. | |
| 2019/0174840 | A1 | 6/2019 | Paulson | |
| 2019/0373961 | A1 | 12/2019 | McKeen et al. | |
| 2020/0107588 | A1 | 4/2020 | Smith | |
| 2020/0120994 | A1 | 4/2020 | Sanchez | |
| 2020/0323279 | A1 * | 10/2020 | Castillo Piedra | A41C 3/0057 |
| 2021/0030077 | A1 | 2/2021 | DeAngelo et al. | |
| 2021/0169152 | A1 | 6/2021 | Sambhu et al. | |
| 2021/0186125 | A1 * | 6/2021 | Lee | A41C 3/0028 |
| 2022/0257404 | A1 | 8/2022 | Brown et al. | |
| 2022/0287385 | A1 | 9/2022 | Dawson | |
| 2022/0304394 | A1 * | 9/2022 | Castillo Piedra | A41C 3/0021 |
| 2022/0338560 | A1 | 10/2022 | Kobayashi et al. | |

FOREIGN PATENT DOCUMENTS

| | | | |
|---|---|---|---|
| DE | 202023106118 | U1 | 12/2023 |
| EP | 3185707 | B1 | 7/2019 |
| FR | 3135192 | A3 | 11/2023 |
| GB | 2199484 | A | 7/1988 |
| GB | 2443787 | A | 5/2008 |
| GB | 2524559 | A | 9/2015 |
| WO | 2015074660 | A1 | 5/2015 |
| WO | 2016030536 | A1 | 3/2016 |
| WO | WO2021250703 | A1 | 12/2021 |
| WO | 2023214124 | A1 | 11/2023 |

* cited by examiner

BREAST SUPPORT GARMENT

CROSS-REFERENCE TO RELATED APPLICATIONS

This application is related to the following co-pending applications, all of which were filed Mar. 12, 2025: application Ser. Nos. 19/077,978; 19/077,982; and Ser. No. 19/077,986.

TECHNICAL FIELD

The present disclosure generally relates to support garments to support breasts, such as, but not limited to, after certain breast surgeries.

BACKGROUND

In general, breast surgery is a procedure that modifies, in some way, the breast of a patient. Such surgeries are done for a variety of reasons. Some are done for cosmetic reasons, such as, for example, to refine the breasts to look more youthful or increase (or in some cases, decrease) their size. Others are medically necessary, such as a breast reconstruction after mastectomy as treatment for breast cancer. Generally speaking, there are several primary types of breast surgeries, including breast augmentation, mastopexy (breast lift), augmentation mastopexy, breast reconstruction, mastectomy, lumpectomy, breast reduction, and tuberous breast correction, to name a few. And there are many variations and types of surgical procedures within each of these broad categories, each surgery affecting the patient's body in possibly different ways. Some of these surgeries (e.g., mastectomy or lumpectomy) lead to other of these surgeries (e.g., reconstruction or augmentation). In many of these surgical procedures, however, the patient undergoes significant trauma not only to the breast and the breast tissue, but also in some cases to the surrounding tissue including lymph nodes, chest musculature, and so forth.

Anatomically, a breast is made up of three main parts: glandular tissue (which includes the lobules and ducts), connective tissue (the fibrous or supportive tissue of which ligaments and scar tissue are made), and fatty tissue that fills in the spaces between the glandular and fibrous tissue. The fatty tissue largely determines breast shape and size. The lobules are the glands that produce milk. The ducts are the tubes that carry milk to the nipple. The connective tissue surrounds and holds everything together. And, of course, in the breast region there are also bands of supportive, flexible connective tissue called ligaments, which stretch from the skin to the chest wall to hold the breast tissue in place. And there are pectoral muscles that lie against the chest wall underneath both breasts, giving them support. Finally, blood vessels provide oxygen to the breast tissue and carry away waste.

The various types of breast surgeries affect the parts of the breast in different ways. For example, a lumpectomy is a procedure that only removes the cancerous tumor and a small margin of normal tissue around it. Therefore, a lumpectomy leaves most of the breast skin, lobules, ducts, and tissue intact, and, most often, the general shape of the breast and the nipple area are preserved. For this reason, a lumpectomy is often referred to as a breast-conserving surgery. A mastectomy, however, is a surgery that removes the entire breast. In a total (simple) mastectomy, a surgeon removes the entire breast and the lining of the chest muscle, but no other tissue. For some women, in a total mastectomy, much of the skin of the breast, sometimes including the nipple, is left intact for breast reconstruction. In a modified radical mastectomy, a surgeon removes the entire breast (including all breast tissue, lobules, and ducts), the lining of the chest muscles, and one or more of the axillary lymph nodes (in the underarm area). This procedure leaves in place only the dermis (or part thereof) that formerly covered the breasts, which must be sutured together to close the surgical site.

As stated, many breast cancer surgeries either involve or lead to other types of breast surgeries. Following some breast cancer surgeries like modified radical bilateral (both breasts) mastectomy, many women opt for some form of breast reconstruction. Reconstruction may be done at the same time as the mastectomy (immediate) or at a later time (delayed).

Nearly all the types of breast surgeries mentioned above involve significant trauma to the breast region. Non-limiting examples of such surgeries include breast augmentation, mastopexy, augmentation mastopexy, breast reconstruction, and certain lumpectomies, breast reductions, and tuberous breast corrections. This trauma translates into significant physical limitations (for example, on types of movements allowed, range of movements allowed, lifting, sleeping positions, activities, and many others), that are imposed on the patient post-surgery. Generally speaking, if the patient adheres to doctors' orders and heals normally, such physical restrictions are gradually lifted. In addition to these physical restrictions, certain wardrobe/clothing restrictions are imposed. Sometimes an overall compression garment is required to be worn by the patient for a time period post-surgery, but as discussed herein, overall compression garments are inadequate for the purposes presently addressed because overall compression garments apply compression typically everywhere as opposed to the specific locations where it is needed. As used herein, the term "garment" is to be construed broadly to include various items of clothing worn or placed on the torso of a patient or user, including but not limited to, shirts, braziers ("bras"), gowns, wraps, and the like (further examples discussed below). By "overall compression", it is meant that the compressive forces applied to the patient by the garment are directed substantially uniformly around the circumference of the patient's torso. That is, the circumference of the garment typically has, or is made from, a substantially elastic material that compresses fairly evenly circumferentially all around the torso.

Currently there are many options for garments that provide overall compression, but even these are often not satisfactory for the limited uses for which they are applicable. For example, sports bras can be too restrictive and are therefore often not comfortable for all-day wear. By contrast, many of the more comfortable, light-weight overall compression sports bras do not provide enough compression and/or support in needed areas. Additionally, many sports bras have no adjustability, so getting a proper fit is difficult. And, overall compression garments apply compression to areas that are not needed (e.g., back, shoulders, etc.). Moreover, sports bras often have no closures, so they must be put on overhead. Most post-surgery breast surgery patients are prohibited from raising their arms overhead in the days and weeks following surgery, so over-the-head bras are not desirable.

While overall compression garments provide some benefits to some patients in certain circumstances, overall compression is not ideal, and in fact is not sufficient for many post-surgery healing purposes. For example, following a breast augmentation, mastopexy, and breast reconstruction surgery (after placement of expanders or implantation of implants), to name a few, it is important to provide targeted, localized compression or support to the side of each breast. One reason for this is that it is important to keep the implant located properly within the capsule (the formation of scar tissue that forms around an implant) it occupies within the breast area beneath the skin. Many implants, regardless whether they are silicon, saline, or other material, have a tendency to migrate laterally and caudally (downwardly) if unsupported. Some amount of "settling" is to be expected, and is indeed normal. However, it is not desirable for the implant to move too far, or to move outside the capsule. During the crucial weeks following implantation, the success of the overall surgery depends greatly on whether the breast was allowed to heal while keeping the implant properly contained within the capsule. Overall compression often is not adequate to keep the implants properly in the capsule to achieve proper healing. Indeed, because no garments exist that can apply localized, targeted compression to breasts for maintaining implants in the capsules, many surgeons instruct their patients during healing to wear some type of overall compression garment, but to stuff a glove, washcloth, or sock between the lateral side of the breast and the inside of the overall compression garment in order to provide the desired localized, targeted "pushing" or compression that is directed medially or partially medially and applied to a specific region of the breast. And, while stuffing a cloth between the breast and the garment provides some desired medial stabilization, it still fails to achieve the desired accurate or repeatable medial force to help ensure that the implant stays in place without migrating. The glove or washcloth is uncomfortable to wear and, invariably, throughout the day it will migrate and move out of position, and in many cases will fall out altogether. To achieve repeatable, directed, consistent, purposeful compression in a particular location and in a desired direction, the current solutions simply are not adequate.

What is needed is a support garment that solves the longstanding need for providing proper medial support for breast implants. It would be desirable for such a garment to provide the ability for a patient to tailor, adjust, add, or remove one or more features of the garment, including, but not limited to, the amount of medial compression or support, the location of such medial compression or support, the size of the footprint that provides the medial compression or support, the direction of the medial compression or support, and the like. It would also be helpful if such medial support functionality were repeatable and, if desired, removable. Such a targeted, localized compression of the breast could also improve the appearance of breasts that have not undergone surgical procedures. Further, because some breast surgery healing protocols involve the need for medial support to patients who have drains, it would be desirable for such garment to also include structure that is convenient for accommodating such drains and/or drain tubes.

SUMMARY

In the embodiments described herein, various solutions are provided to the various problems encountered in the need for the unique type of support needed for breast tissue in various circumstance.

In an embodiment, a support garment comprises a left cup configured to receive a left breast when the garment is worn by a user and a right cup configured to receive a right breast when the garment is worn by a user. The left cup includes a base and a left cup length projection. The right cup includes a base and a right cup length projection. The support garment also includes a rear panel. The support garment also includes a left wing connecting the left cup to the rear panel. The left wing has a pocket therein and the pocket includes a pocket opening configured to receive therethrough a pad. The support garment also includes a right wing connecting the right cup to the rear panel. The right wing has a pocket therein and the pocket includes a pocket opening configured to receive therethrough a pad.

In another embodiment, a support garment comprises a left cup configured to receive a left breast when the garment is worn by a user, wherein the left cup has a left cup length projection. The support garment also includes a right cup configured to receive a right breast when the garment is worn by a user, wherein the right cup has a right cup length projection. The support garment includes a center panel further comprising a first portion and a second portion, wherein the first portion includes a first closure mechanism portion thereon and wherein the second portion includes a second closure mechanism portion thereon configured to mate with the first closure mechanism portion and to thereby selectively couple and decouple the second portion to the first portion. The support garment includes a rear panel; a left wing connecting the left cup to the rear panel; a left strap connecting the left cup to the rear panel and spaced away from the left wing in a cephalad direction to create a first arm hole therebetween; a right wing connecting the right cup to the rear panel; and a right strap connecting the right cup to the rear panel and spaced away from the right wing in a cephalad direction to create a second arm hole therebetween. The left wing further comprises a pocket therein located between a midline axis of the garment and a point that is anteriorly spaced from the midline axis a distance equal to approximately 60 percent of the left cup length projection, the pocket including a pocket opening configured to receive therethrough a pad. The right wing further comprises a pocket therein located between a midline of the garment and a point that is anteriorly spaced from the midline axis a distance equal to approximately 60 percent of the right cup length projection, the pocket including a pocket opening configured to receive therethrough a pad.

In another embodiment, a method of supporting a breast within a garment is provided comprising the steps of: providing a garment having a left cup configured to receive a left breast of a user, a right cup configured to receive a right breast of a user, a rear panel, a left wing connecting the left cup to the rear panel, and a right wing connecting the right cup to the rear panel; wherein the left wing further comprises a left wing pocket therein configured to receive a pad through a left wing pocket opening, and wherein the right wing further comprises a right wing pocket therein configured to receive a pad through a right wing pocket opening. The method further includes a step of selecting a first pad and inserting the first pad through the left wing pocket opening into the left wing pocket. The method further includes a step of placing the garment on a user's body in a manner such that the user's left breast is received in the left cup; the user's right breast is received in the right cup; and the first pad is located on a lateral side of the user's left breast between a midline axis of the garment and a point that is anteriorly spaced from the midline axis a distance equal to approximately 60 percent of a left cup length projection.

These and other advantages and features, which characterize the invention, are set forth in the claims annexed hereto and forming a further part hereof. However, for a better understanding of the invention, and of the advantages and objectives attained through its use, reference should be made to the figures, and to the accompanying descriptive matter, in which there is described example embodiments of the invention. This summary is merely provided to introduce a selection of concepts that are further described below in the detailed description, and is not intended to identify key or essential features of the claimed subject matter, nor is it intended to be used as an aid in limiting the scope of the claimed subject matter.

BRIEF DESCRIPTION OF THE DRAWINGS

The embodiments set forth in the drawings are illustrative and exemplary in nature and not intended to limit the subject matter defined by the claims. The following detailed description of the illustrative embodiments can be better understood when read in conjunction with the following drawings, where like structure is indicated with like reference numerals and in which:

FIGS. 7A-70 are schematic views of various embodiments of pads for use in the support bra according to some embodiments.

DETAILED DESCRIPTION

The embodiments described herein are directed to various types, styles, and embodiments of a breast support garment having adjustable side compression. The following description is provided with reference to the accompanying figures. As used herein, for the sake of convenience, the term "bra" is often used interchangeably with the term "garment". No limitation is intended by the use of either term.

Figure 1A:
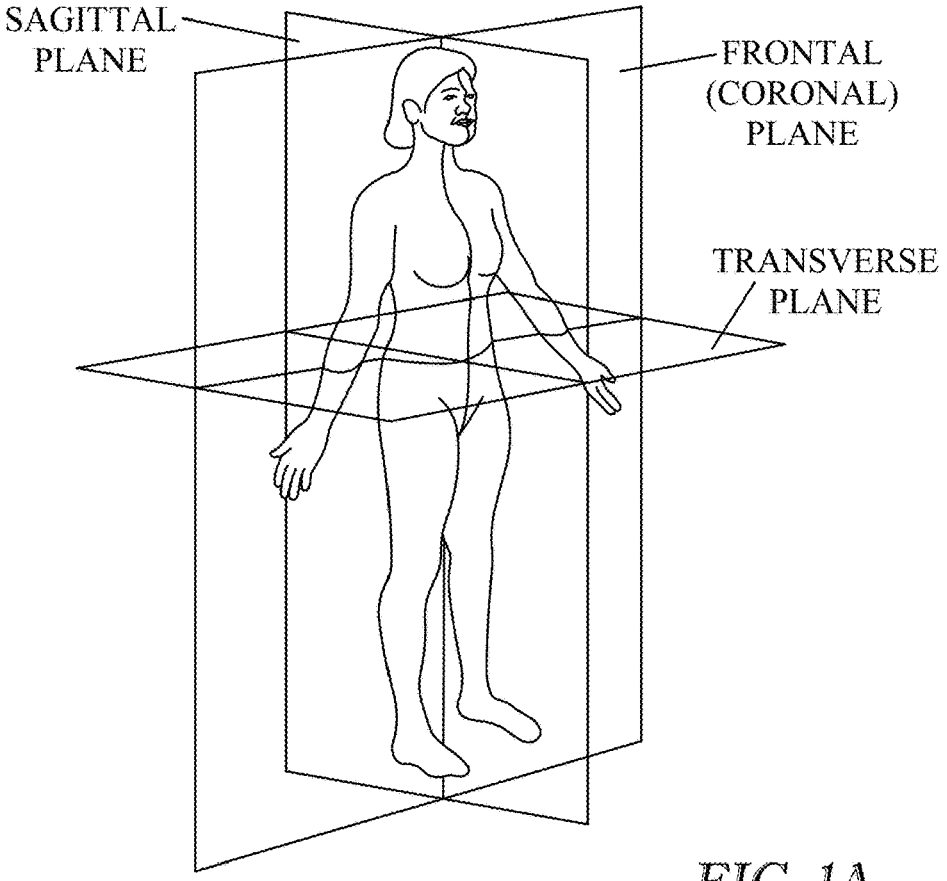
FIG. 1A is a diagram depicting common anatomical reference planes.
Figure 1B:
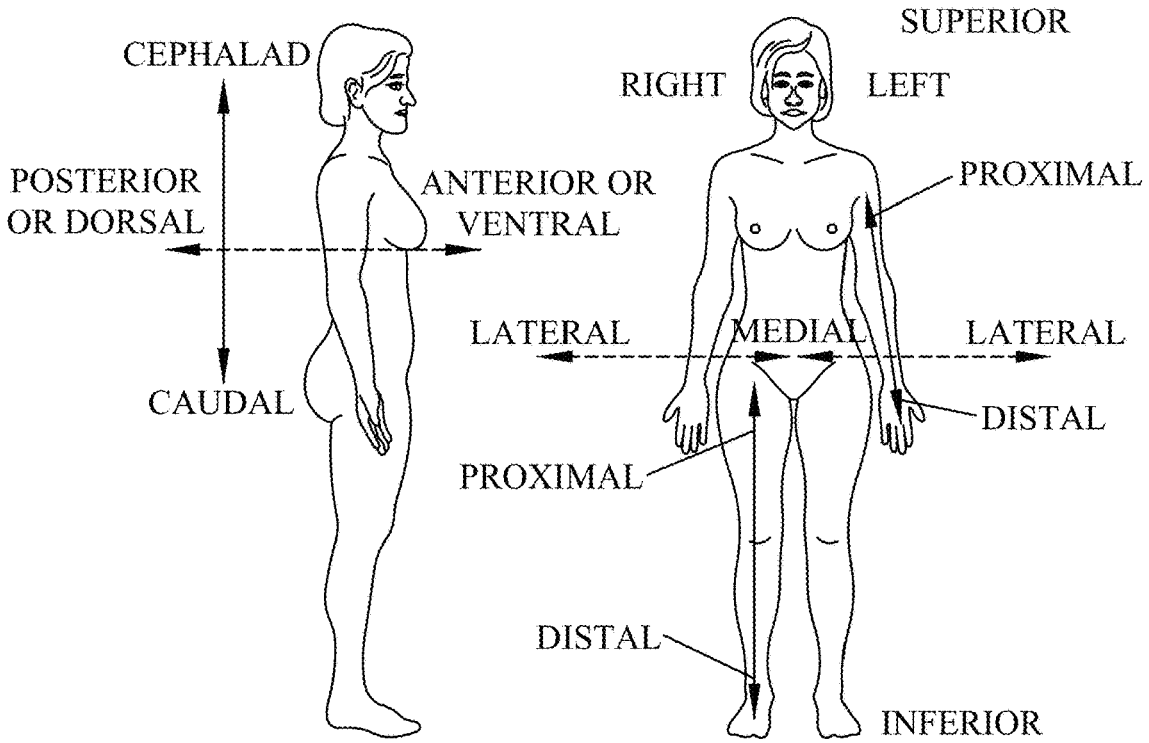
FIG. 1B is a diagram depicting common anatomical reference directions.

As discussed, women who undergo various breast surgeries need support garments to achieve certain functions. The garments described herein will be seen as being wearable on a human, and in particular worn about the torso of a human around the breast region. To facilitate the discussion of the various embodiments discussed herein, reference will be made to certain anatomical reference nomenclature. FIGS. 1A and 1B depict various reference planes and directions that will be referred to herein. When discussing the nature of the garments described, the term "circumferential" generally means surrounding or around the torso. That is, when worn, the garments traverse around the torso circumferentially. Also, in general, the garments described here, when worn, are substantially continuous, meaning they go all the way around the user's body, circumferentially. And, the garments described are not limited to being worn by patients of breast surgeries. Indeed, the garments described herein can be worn by any user who desires additional medial support for breasts, whether for medical or simply aesthetic reasons. As used throughout, sometimes it may be described in some situations that medial force or compression is desired and is provided by the embodiments. Unless otherwise explicitly described or indicated, this is not intended to be a limitation indicating that only purely medial force or compression is being discussed or is being provided by the embodiments. Indeed, it may be that medial force or compression is being applied, or medial-caudal force or compression, or medial-cephalad force or compression is being applied, or any combinations thereof. However, throughout the discussion, each and all of these descriptions of force and compression are intended to be juxtaposed against the overall compression that is afforded by many common bras available today.

FIGS. 2-6 and 8-10 depict various views of embodiments of a garment 10. The garment 10 is depicted herein as a bra for ease of understanding and consistency in the figures. It should be understood, however, that the garment 10 need not be a bra per se, but could be any of a number of other types of garments that can be worn about the torso of a human to provide support to the breast region, including but not limited to corsets, camisoles, bustiers, bandeaus, bands, body suits, tube tops, compression garments, and the like. Similarly, it should also be understood that, among bras, the specific style of bra depicted in the figures is not intended to be limiting. Indeed, the features provided by the garment 10 can be equally applicable to other styles of bras not shown in the figures herein, including, but not limited to, full cup bras, sports bras, push-up bras, strapless bras, demi bras, triangle bras, plunge bras, balconettes, nursing bras, and the like. Some of these types of bras may not have all of the components described herein. As but one example, a strapless bra will not comprise straps. Furthermore, the garment 10 described herein can be a garment that is not openable (i.e., does not have a closure mechanism); or can be a garment 10 having a rear closure; or can be a garment having a front closure. For the sake of simplicity the figures depict front-closure embodiments.

Garment

As shown in FIGS. 2-6, the garment 10 can be provided in various embodiments, where some embodiments include some or all of certain components, including: cups (including a left cup 20 and a right cup 30); a center panel 40; a lower band 50; wings (including left wing 60 and right wing 70); a rear panel 80; straps (including a left strap 90 and a right strap 100); first medial compressor 110; and second medial compressor 120. As will be seen, some of these components may be described in alternative ways, wherein various portions of each component might also be characterized as being a part of a different component. This is due to the fact that some of the components are continuous in nature, traversing along a varying distance along and around the garment 10. For example, it may be subject to interpretation where the lower band 50 begins and ends vis-à-vis the center panel 40. Similarly, it may be subject to interpretation where the left wing 60 or right wing 70 begins and ends vis-à-vis the left cup 20 and right cup 30, respectively, or vis-à-vis the rear panel 80. The figures and description provided herein adopt a single view of such components merely for ease of description and understanding, but it should be understood that some variation is possible, and the depicted and described embodiments are not intended to be limiting. Therefore, usage of particular words for these sections of the garment 10 are not intended to indicate that that exact structure must be present in that exact arrangement. In addition, not all of the components described herein as constituting parts of the garment 10 are required to be included in any given garment. Indeed, various embodiments are described, and contemplated, to include many combinations of, but not all of, these components.

Figure 2:
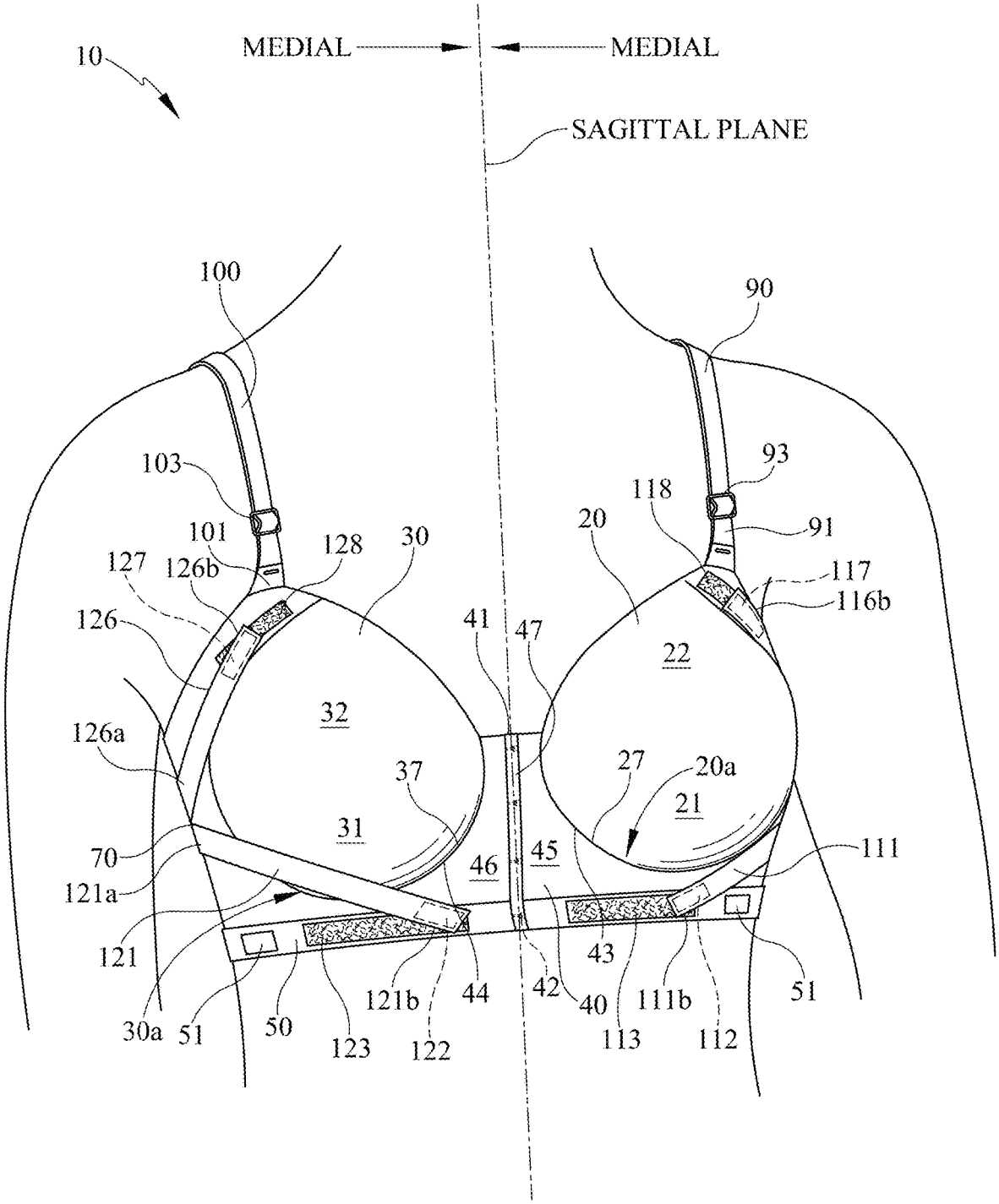
FIG. 2 is a perspective view of a user wearing a support bra according to an embodiment.
Figure 3:
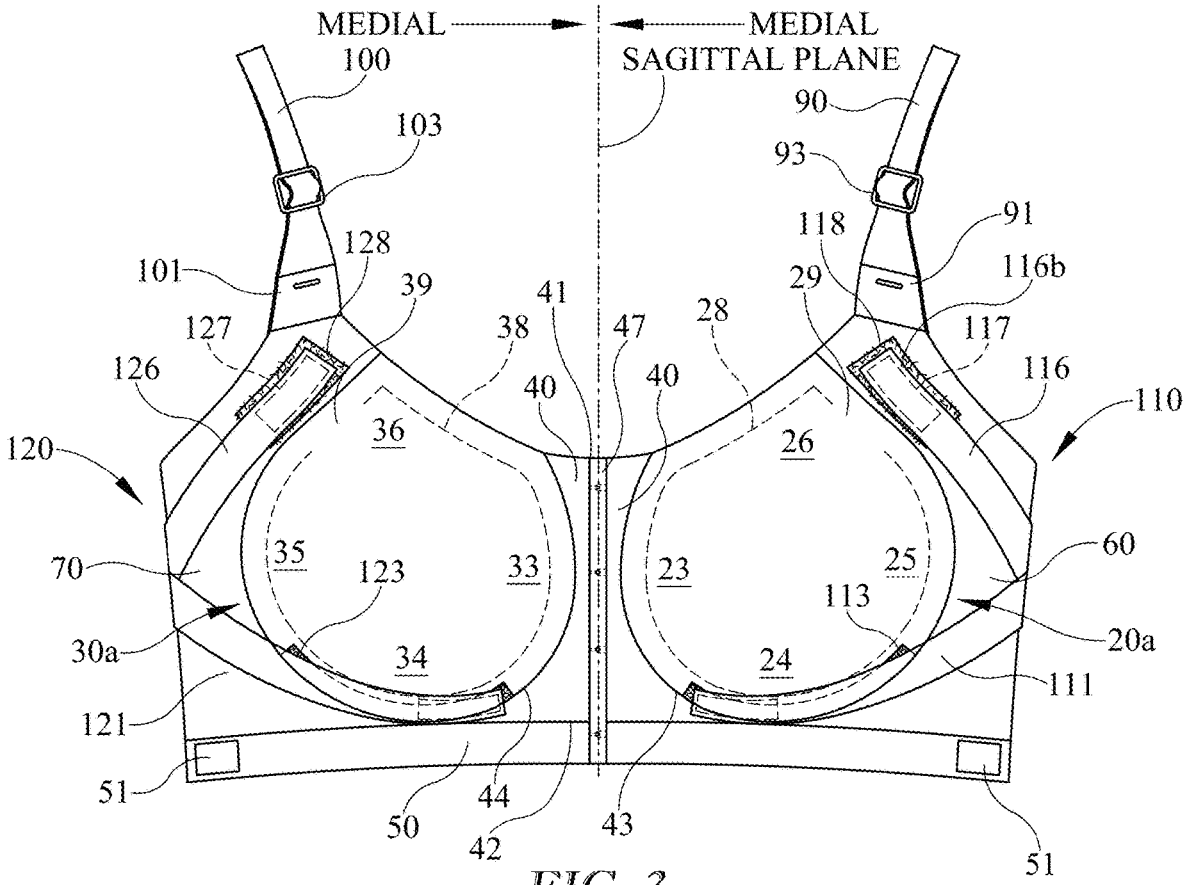
FIG. 3 is a front view of a support bra according to an embodiment.
Figure 4:
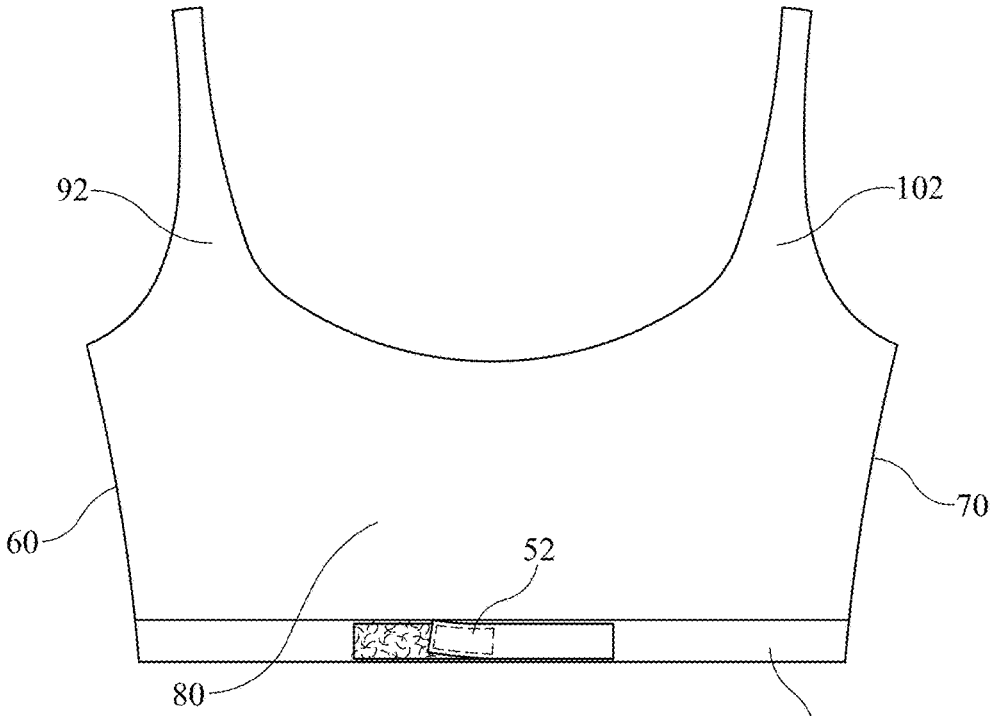
FIG. 4 is a back view of the support bra shown in FIG. 3.

With reference now to FIGS. 2-4, FIG. 2 shows a garment 10 being worn by a user. The garment 10 of this embodiment includes a left cup 20, right cup 30, left strap 90, right strap 100, closure mechanism 47, left wing 60, right wing 70, first medial compressor 110, and second medial compressor 120. The left cup 20 can be a single item, or can be made of multiple subcomponents or parts sewn together, as an example, two parts, a lower cup 21 and an upper cup 22. Indeed, owing to the variation in component locations and start/stop points discussed above, the left cup 20 might comprise more than two subcomponents. For example, there might be a lower cup 21 and an upper medial cup and an upper lateral cup. Or there might be an upper cup 22 and a lower medial cup and a lower lateral cup. For the sake of simplicity, in the figures, the left cup 20 is depicted as comprising a single cup. The upper cup 22 (and, if no upper cup 22 is present, then the left cup 20 itself) can help provide some shape to the breast and/or can provide visual appeal to the bra (e.g., the upper cup 22 might comprise lace). The lower cup 21 (and, if no lower cup 21 is present, then the left cup 20 itself) generally provides caudal support to the left breast, supporting the left breast vertically and also providing some lateral support and some medial support. The left cup 20 (alternatively and/or lower cup 21 and/or upper cup 22) can be made of many materials, some of which can provide a measure of elasticity, while others could be more firm and relatively non-elastic. The left cup 20 (and/or lower cup 21 and/or upper cup 22) can be lined or padded if desired. In general, it can be understood that the left cup 20 has a perimeter circumscribing the lower portion, or cup base 20*a*, of the cup (whether or not subcomponents lower cup 21 and/or upper cup 22 are present). As shown in FIG. 3, the perimeter can be viewed as having certain regions: a medial region 23, a caudal (lower) region 24, a lateral region 25, and a cephalad (upper) region 26. References to the left cup 20 herein should be deemed to contemplate and include references to (a) a left cup 20 that is a single cup and/or (b) a left cup 20 that is comprised of two or more subcomponents that, together, make up a left cup 20 and that collectively include such regions thereon.

Similarly, the right cup 30 can be a single item, or can be made of multiple subcomponents or parts sewn together, as an example, two parts, lower cup 31 and an upper cup 32. Indeed, owing to the variation in component locations and start/stop points discussed above, the right cup 30 might comprise more than two subcomponents. For example, there might be a lower cup 31 and an upper medial cup and an upper lateral cup. Or there might be an upper cup 32 and a lower medial cup and a lower lateral cup. For the sake of simplicity, in the figures, the right cup 30 is depicted as comprising a single cup. The upper cup 32 (and, if no upper cup 32 is present, then the right cup 30 itself) can help provide some shape to the breast and/or can provide visual appeal to the bra (e.g., the upper cup 32 might comprise lace). The lower cup 31 (and, if no lower cup 31 is present, then the right cup 30 itself) generally provides caudal support to the right breast, supporting the right breast vertically and also providing some lateral support and some medial support. The right cup 30 (alternatively and/or lower cup 31 and/or upper cup 32) can be made of many materials, some of which can provide a measure of elasticity, while others could be more firm and relatively non-elastic. The right cup 30 (and/or lower cup 31 and/or upper cup 32) can be lined or padded if desired. In general, it can be understood that the right cup 30 has a perimeter circumscribing the lower portion, or cup base 30*a*, of the cup (whether or not subcomponents lower cup 31 and/or upper cup 32 are present). Referring again to FIG. 3, the perimeter can be viewed as having certain regions: a medial region 33, a caudal (lower) region 34, a lateral region 35, and a cephalad (upper) region 36. References to the right cup 30 herein should be deemed to contemplate and include references to (a) a right cup 30 that is a single cup and/or (b) a right cup 30 that is comprised of two or more subcomponents that, together, make up a right cup 30 and that collectively include such regions thereon.

In other embodiments, with or without front closure capability, each cup 20, 30 can join to the other cup 30, 20 at a center of the garment 10. For garments 10 that are front-closure garments, each cup 20, 30 can comprise a mating portion of a closure mechanism 47. Many types of closure mechanisms are possible, including, without limitation, zippers, hook and loop, hook and eye, buttons, snaps, clasps, magnets, rings, post and receiver, and any other form of male/female closure suitable for garments. Some garments 10 (as shown in the figures) might include an identifiable center panel 40 (described below) between the left cup 20 and right cup 30. This center panel 40 could house the closure mechanism 47 such that the cups 20, 30 do not themselves have a closure mechanism.

As shown in FIG. 3, the left cup 20 can, if desired, also include a pocket 28 having a pocket opening 29. The pocket 28 can house a pad that can be permanently within the pocket 28 or can be a removable prosthesis or removable pad for enhanced smooth appearance. Similarly, the right cup 30 can, if desired, also include a pocket 38 having a pocket opening 39. The pocket 38 can house a pad that can be permanently within the pocket 38 or can be a removable prosthesis or removable pad for enhanced smooth appearance. In many embodiments described herein the pads are removable.

Figure 10:
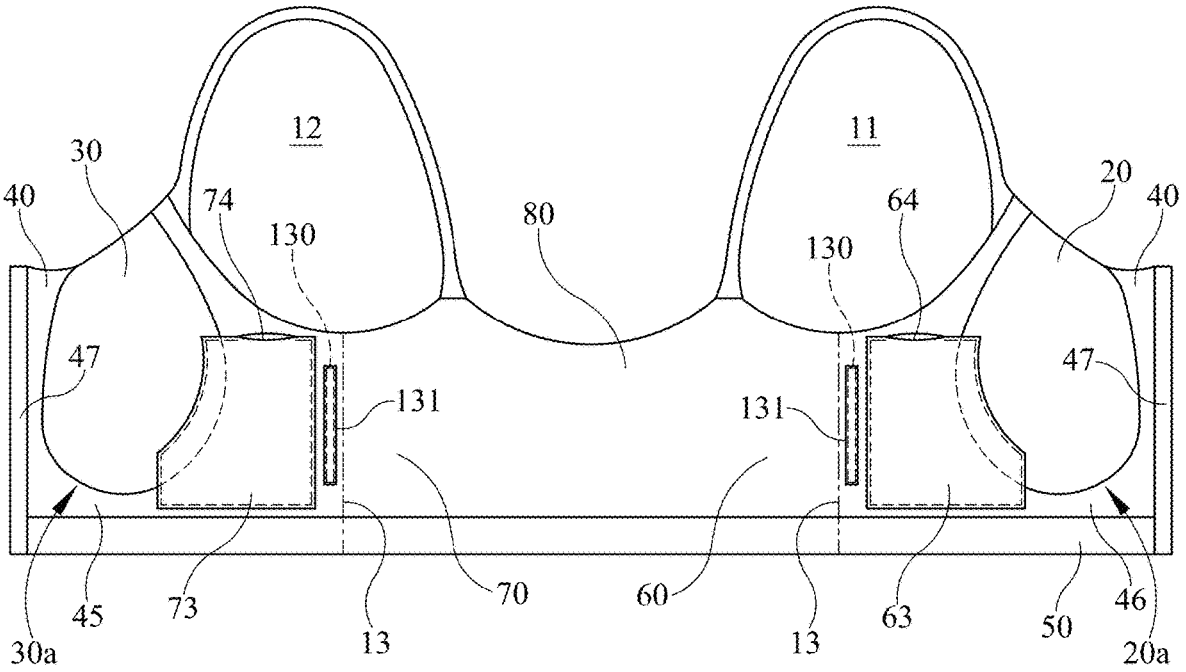
FIG. 10 is a view of the inside of a support bra laid open flat, according to an embodiment.

With reference to FIGS. 2, 3, and 10, the garment 10 may (but need not) include a center panel 40 that is a component between the left cup 20 and right cup 30 where the left cup 20 and right cup 30 meet. The center panel 40 can be a solid material (e.g., in embodiments where the garment 10 closure is in the rear) or can comprise closure mechanisms 47 for a front-closuree garment 10. The center panel 40 can have a top 41 and a bottom 42. The center panel 40 can take on a number of shapes and sizes, depending in part on the size and style of the bra and the size and style of the left cup 20 and right cup 30. The center panel 40 can have left lateral edge 43 and a right lateral edge 44. The left lateral edge 43 is joined to the medial region 23 of the left cup 20 at a first seam 27. The right lateral edge 44 is joined to the medial region 33 of the right cup 30 at a first seam 37.

As stated, for many post-surgery patients, the garment 10 is desired to be openable, either from the front or from the rear. This is due in part because many such patients are instructed not to raise their arms above their shoulders, so a garment 10 needs to be able to be put on without doing so. This means that the preferred garment 10 should be openable with a closure mechanism of some sort. In the preferred embodiments (for post-surgery patients) the garment is a front-closure garment 10 because opening from the front allows the user to more easily put on and take off the garment 10 without assistance from others, especially where arm movements are limited by doctors' orders. In the front-opening configuration, where there is a center panel 40, the center panel 40 is made of two portions, a left portion 45 and a right portion 46. Each portion includes one half of a closure mechanism 47. The closure mechanism can be any of the common types of closure mechanisms for garments, including, but not limited to, hook/eye, hook/loop, zipper, snaps, buttons, clasps, magnets, rings, post/receiver, and the like. Each portion 45, 46, for example, would include a closure feature that mates with a mating closure feature of the other portion 46, 45, respectively.

With continued reference to FIGS. 2-6, and FIGS. 8-10, some garments 10 may include a lower band 50. Lower band 50 resides below the left cup 20, right cup 30, and, if present, center panel 40. The lower band 50 can also extend all the way, or in some embodiments substantially all the way, around the lower perimeter of the garment 10. The lower band 50 is generally comprised of or contains elastic material so as to provide some stretch to the garment 10 and to provide some overall compression against the torso when worn. Generally, the caudal region 24 of the left cup 20 is joined at or adjacent to the lower band 50 at a portion of the first seam 27. Similarly, the caudal region 34 of the right cup 30 is joined at or adjacent to the lower band 50 at a portion of the first seam 37. As discussed, many components of the garment 10 are continuous in nature, and therefore where certain components are joined, such seams are also continuous. Therefore, it is possible that first seam 27 continues the entire way around the joint between the medial region 23 of the left cup 20, to and including the caudal region 24 of the left cup 20, and to and including the lateral region 25 of the left cup 20. It is also possible that the first seam 27 may be divided into subsections of different seams or different seam portions. For the sake of simplicity in understanding, the first seam 27 is depicted as traversing around, and including, the entire joint between the medial region 23 and the left lateral edge 43; and also the joint between the caudal region 24 and the lower band 50; and also the lateral region 26 and the left wing 60 (described below).

Similarly, it is possible that first seam 37 continues the entire way around the joint between the medial region 33 of the right cup 30, to and including the caudal region 34 of the right cup 30, and to and including the lateral region 35 of the right cup 30. It is also possible that the first seam 37 may be divided into subsections of different seams or different seam portions. For the sake of simplicity in understanding, the first seam 37 is depicted as traversing around, and including, the entire joint between the medial region 33 and the right lateral edge 44; and also the joint between the caudal region 34 and the lower band 50; and also the lateral region 36 and the right wing 70 (described below). Additional seams are possible at numerous locations on the garment 10, and some seams may be reinforced for structure and support purposes.

In some embodiments, the lower band 50 can further include an overall compression adjuster 52 (FIG. 4), which can be located in the back or the front of the lower band 50. Preferably the overall compression adjuster 52 is in the back of the garment 10. The overall compression adjuster 52 serves to provide adjustability to the amount of overall compression the lower band 50, and the garment 10 in general, provides to the user. The overall compression adjuster 52 can take many forms. One example is a strap with sequential hook and eye fasteners (akin to traditional hook/eye fasteners that are used to fasten bras) in which the user can select which set of eyes to mate with the hook or hooks. Another example (see FIG. 4) is a strap with male/female hook/loops thereon. A third example is a strap with a non-slip adjustable clip, similar to what is on many bra straps (like left strap 90 and right strap 100). A fourth example includes mating male/female components that reside within the lower band 50 itself, without the need for a separate strap. Another example is a button with a series of button holes spaced at predetermined spacings along the lower band 50, such that moving the button into different button holes adjusts the overall compression of the garment 10. Another example is a strap with male or female hook/loops thereon and an eye through which the strap can be inserted and then doubled back onto itself, where mating female/male loop/hook materials exists. These listed examples are just some of the many types of adjustment mechanisms that are possible and would be commonly understood.

In many prior art bras, the lower band 50 can alternatively include a space or a channel for an underwire. While structurally possible, the garment 10 according to the preferred embodiments discussed herein does not include a channel or space for an underwire because an underwire is not recommended to be worn by many post-breast surgery patients. Users who are not post-breast-surgery patients may, however, desire underwires in the garment 10. The lower band 50 can also include stiffening material that is not a wire and, as such, has a lower chance of poking the implants and possibly rupturing them or causing other damage. Such non-wire stiffeners might include, as but a few examples, various types of plastics, resins, "boning", and the like.

In some alternative embodiments, such as following surgeries where the patient has one or more internal drain tubes coupled to squeezable bulbs, the garment 10 (either at or near the lower band 50, or elsewhere on the garment 10) can include one or more receivers 51, such as, for example, loops, hook/loop fabric, grommets, openings, or other structures to receive drain tubes or clips for holding the drain tubes and/or bulbs in place. Such receivers 51 are optional and preferably are not included on a garment 10 for use by a patient who does not have drains.

Referring again to FIGS. 2-6 and FIGS. 8-10, each side of the garment 10 has a section of fabric connecting the front of the garment 10 to the back of the garment 10. In the embodiments shown, these portions of fabric are referred to as wings. In particular, a left wing 60 connects the lower band 50 (if included) beneath the left cup 20 to the back of the garment 10. Similarly, a right wing 70 connects the lower band 50 (if included) beneath the right cup 30 to the back of the garment 10. As discussed above, it is possible these features are not identifiably distinct items from the rear of the garment or the cups, but could be viewed as, for example, an extension of the rear panel 80. In all cases, as used herein, the wings 60, 70 are deemed to refer to those portions of the garment 10 that are located at positions on the garment 10 where identifiable wings 60, 70 would be located. As mentioned, some embodiments might not include a designated separate lower band 50. Indeed, some embodiments might not have separate, designated wings 60, 70, but instead might have extensions of the left cup 20 and right cup 30 that extend around the garment 10 to the back side. In the preferred embodiment, however, left wing 60 and right wing 70 are included, and are made of material that has adequate sturdiness, yet includes some amount of stretch or elasticity to be comfortable to wear and also provide some level of compression as needed.

In the embodiments shown in FIGS. 3, 5A-5C, and 8-10, the left wing 60 includes a top portion 61 that defines a bottom of a left arm opening 11, and a bottom portion 62 that is either adjacent to, or coexistent with, the lower band 50. The left wing 60 is positioned on the garment 10 in such a location that, when worn on the torso by a user, the left wing 60 rests against a lateral and/or against a lateral-cephalad surface and/or lateral-caudal surface of a left breast of a user. Similarly, the right wing 70 includes a top portion 71 that defines a bottom of a right arm opening 12, and a bottom portion 72 that is either adjacent to, or coexistent with, the lower band 50. The right wing 70 is positioned on the garment 10 in such a location that, when worn on the torso by a user, the right wing 70 rests against a lateral and/or against a lateral-cephalad and/or lateral caudal surface of a right breast of a user.

Referring now to FIGS. 5B-C, 6B-C, and 8-10, in some embodiments, the left wing 60 and right wing 70 may further include "bone" or "boning" 130. The bone 130 is a relatively thin rod-like or plate-like component that is typically sewn into a seam 131. The bone 130 can be sewn into an inner surface or an outer surface of any portion of the garment 10, including but not limited to the left wing 60 and/or right wing 70. Typically, the bone 130 in this region is sewn into an inner surface and is oriented generally in a cephalad-caudal direction to provide shape and/or support to the garment 10. In particular, the bone 130 can be included to provide structural support against which medial compressors (described below) act. The presence of bone 130 strengthens the garment 10 in this area and helps to handle force applied to the wings 60, 70 by the tension in the medial compressors. As shown in FIGS. 5B and 5C and 6B and 6C, preferably the bone 130 (if present at all) resides in the garment 10 at a location that, when worn by a user, is at, or slightly anterior of, the coronal plane midline axis (vertical dashed line in FIGS. 5A-C, 6A-C, 8, 9, 10, and 12B). This axis coincides with what is referred to herein as the midline axis 13 of the garment 10. The bone 130 has a length that is slightly less than the overall height of the left wing 60 and right wing 70. The bone 130 is made of any material commonly used for boning, including, but not limited to, various plastics, resins, composites, metals, alloys, and the like. The bone 130 can also be made of materials not commonly used for boning but that provides some level of strength and rigidity, including, but not limited to, built-up or multiple layers of relatively non-rigid material that become more rigid when layered together.

As shown in FIG. 4, the garment 10 further typically includes a rear panel 80. This rear panel 80 connects to the left wing 60 and the right wing 70 on the back side of the garment 10. The rear panel 80 can be a single piece (e.g., for a front-closure garment 10) or can be segmented or separated and include a left closure mechanism 81 and a complementary right closure mechanism 82 for a rear-closure garment 10 (not shown). In the preferred embodiment for post-breast surgery patients, the rear panel 80 is a single piece and the closure mechanisms are on the front of the garment 10, either at the left cup 20 and right cup 30, or at the center panel 40 (if present). The rear panel 80 is typically made from somewhat elastic material and can be made from materials of varying elasticity. The rear panel 80 can be formed in various shapes to provide various styles of back. Non-limiting examples include square back; straight; ballet, leotard, or U-back; V-back; racer back; T-back; low back; X-back; and the like.

The garment 10 according to certain embodiments further includes a left strap 90 and a right strap 100. The left strap 90 connects the left cup 20 and/or center panel 40 to the rear panel 80. The right strap 100 connects the right cup 30 and/or center panel 40 to the rear panel 80. The left strap 90 typically has a first end 91 connected to the front (i.e., the left cup 20) and a second end 92 connected to the rear panel 80. The right strap 100 typically has a first end 101 connected to the front (i.e., the right cup 30) and a second end 102 connected to the rear panel 80. The circumferential opening formed by the left strap 90 and the top portion 61 of the left wing 60 provides an opening through which a user's left arm is insertable. The circumferential opening formed by the right strap 100 and the top portion 71 of the right wing 70 provides an opening through which a user's right arm is insertable. The left strap 90 further includes an adjuster 93 (FIG. 1) that can alter the overall length of the left strap 90. The adjuster 93 can be any of the common types of bra strap adjusters, and preferably is a non-slip bra clip. For many users, including especially post-breast-surgery women, the preferred location of the adjuster 93 is on the front portion of the left strap 90. In this location, the user can easily adjust the left strap 90 while wearing the garment 10 without assistance. Similarly, the right strap 100 further includes an adjuster 103 (FIG. 1) that can alter the overall length of the right strap 100. The adjuster 103 can be any of the common types of bra strap adjusters, and preferably is a non-slip bra clip. For post-breast-surgery patients, who typically have limited range of motion in their arms, the preferred location of the adjuster 103 is on the front portion of the right strap 100. In this location, the user can easily adjust the right strap 100 while wearing the garment 10 without assistance.

As discussed, the garment 10 provides benefits to its wearer because it provides means of applying localized, targeted compression in particular locations and particular directions. This enables the garment 10 to retain the implants and/or adjusters properly within the capsule of the breast cavities for healing. This also benefits users who are not post-surgery patients and who simply want localized, targeted compression of the breasts to provide a pleasing appearance and/or improved cleavage that comes from such targeted compression. The garment 10 therefore can provide the pleasing appearance of a push-up or lifting bra for users who have not undergone breast surgery. The garment 10 includes several structures that enable such functionality, which are discussed in turn below.

Targeted Compression-Removable Pads

Figure 11:
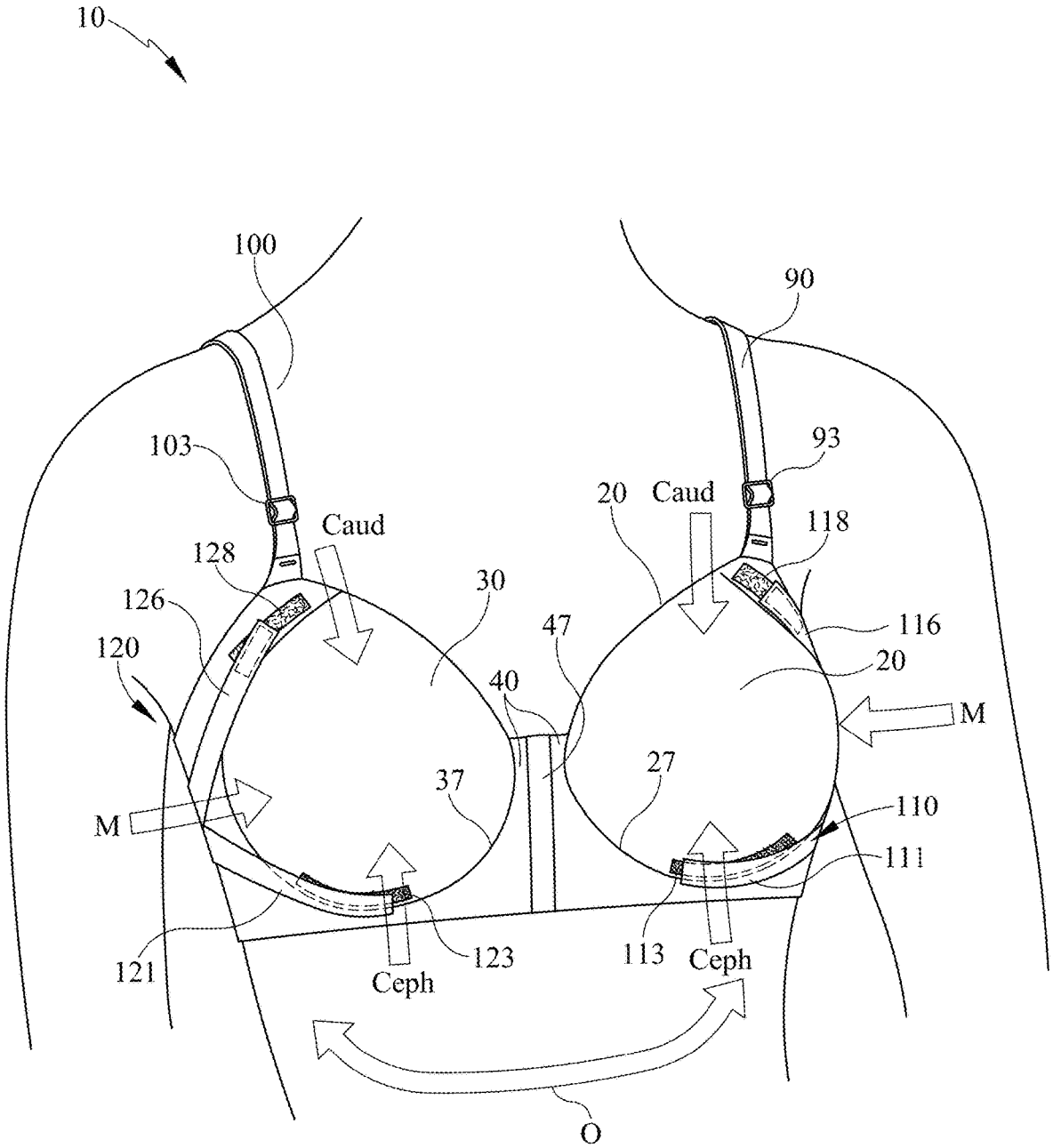
FIG. 11 is a perspective view of a user wearing a support bra according to an embodiment, depicting directions of various forces acting on the user's breasts resulting from features of the support bra.

Advantageously, the garment 10 includes one or more features that are configured to provide the desired localized, targeted compression in a medial and/or in a cephalad-medial and/or a caudal-medial direction. FIG. 11 depicts a close-up of a user's breasts wearing a garment 10 and shows various forces acting upon the breasts by various features of the garment 10. Overall compression (arrow "O") was discussed above and acts circumferentially around the user's torso. In many cases for users, a garment that simply provides overall compression does not provide the targeted, localized compression required to keep the user's breast implants and/or expanders in the proper location in the capsules during the many weeks needed for proper healing after surgery. Proper healing is improved with targeted, localized, and directed compression provided by the garment 10. Medial compression (arrow "M") is defined herein as compression that acts primarily in a medial direction (that is, toward the mid-line of the coronal plane where the sagittal plane intersects). Cephalad compression (arrow "Ceph") is defined herein as compression that acts primarily in a cephalad direction (that is, toward the cephalad (superior) end of the user in either the sagittal plane or the coronal plane). Caudal compression (arrow "Caud") is defined herein as compression that acts primarily in a caudal direction (that is, toward the caudal (inferior) end of the user in either the sagittal plane or the coronal plane). As will be seen, various features of the garment 10 provides the ability to impart compression forces in each of these directions, and in combinations of these directions.

Figure 7A:
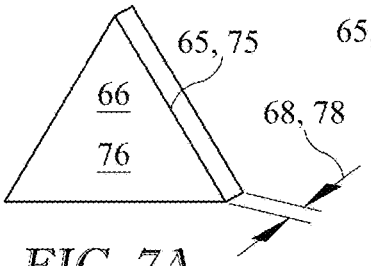
Figure 7B:
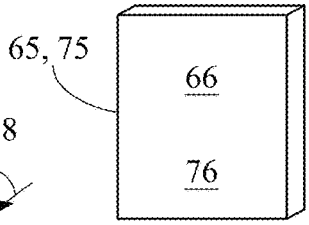
Figure 7C:
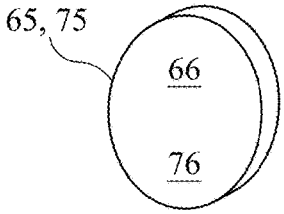
Figure 7D:
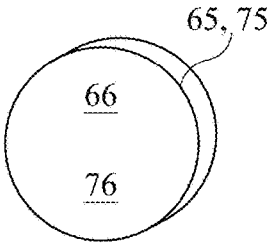
Figure 7E:
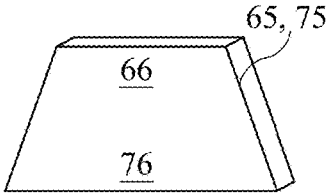
Figure 7F:
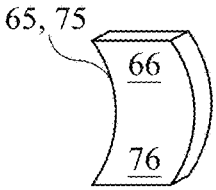
Figure 7G:
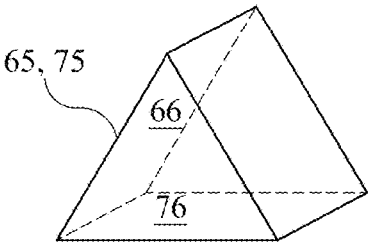
Figure 7H:
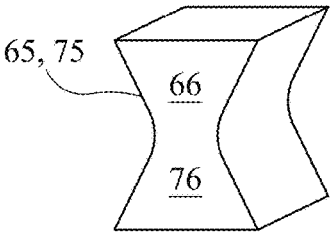
Figure 7I:
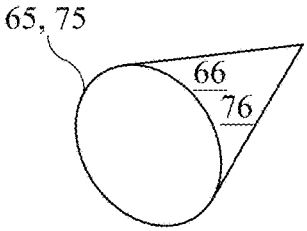
Figure 7J:
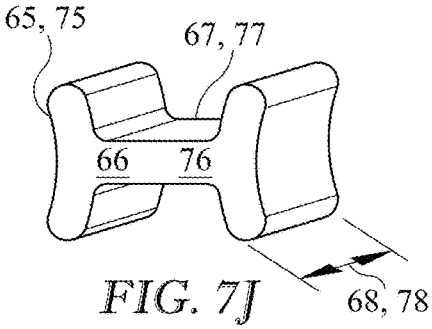
Figure 7K:
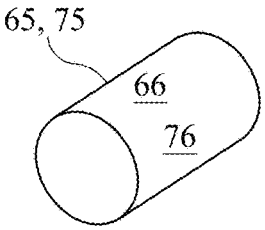
Figure 7L:
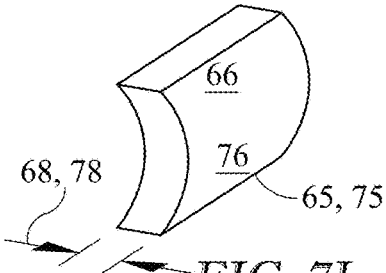
Figure 7M:
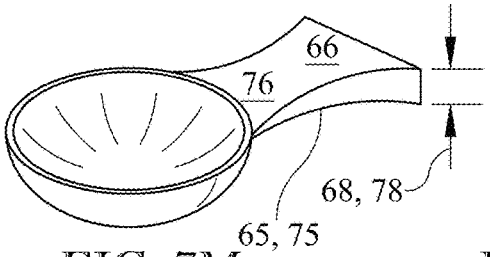
Figure 7N:
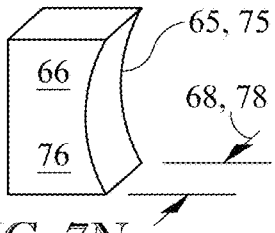
Figure 7O:
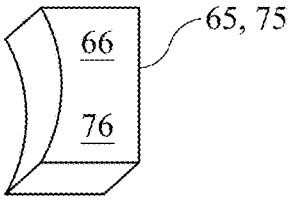
Figure 8:
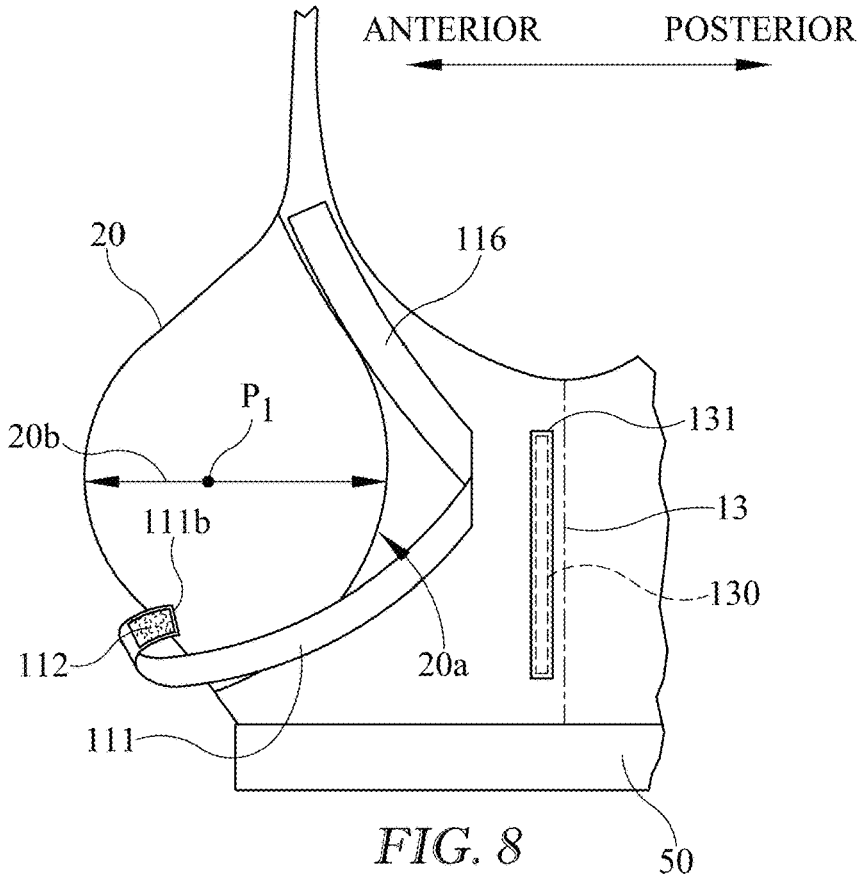
FIG. 8 is a partial left side exterior view of a support bra according to an embodiment.
Figure 9:
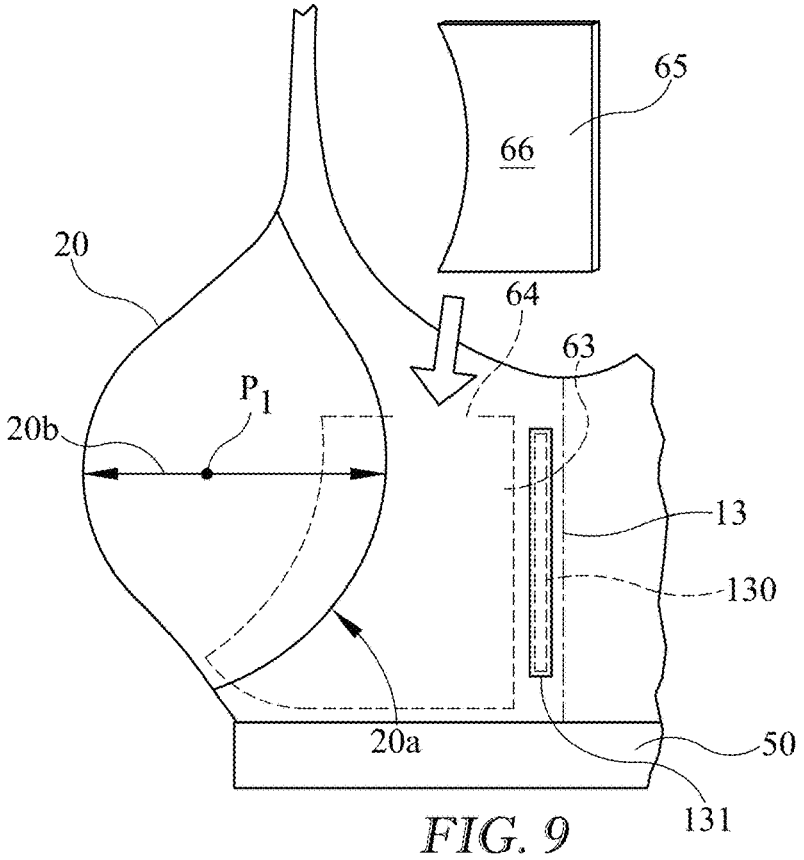
FIG. 9 is a partial left side exterior view of a support bra according to another embodiment.

Referring to FIGS. 3-5A and FIGS. 8-10, in one embodiment, the left wing 60 includes a pocket 63 having a pocket opening 64. The pocket 63 can be a separate pocket sewn into the left wing 60, or alternatively can be simply a cavity (bounded by seams) located in between two layers that make up the left wing 60. The pocket 63 is located on the left wing 60 such that it overlies at least a portion of the lateral surface of the left breast of a user when the garment 10 is worn. The pocket 63 is sized to receive a pad 65 therewithin. The pad 65 is insertable through the pocket opening 64. The pocket opening 64 can, if desired, include a closure mechanism 64*a* (e.g., a snap, zipper, hook/loop material, hook/eye, overlapping flap, and so forth). However, this is not required, and in the preferred embodiment the pocket opening 64 does not have a separate closure mechanism 64*a*, but rather the pocket opening 64 itself provides adequate retention of the pad 65 therewithin. The pocket opening 64 can be located generally at any location on the left wing 60, but in the preferred embodiment the opening 64 is located at the superior end of the pocket 63 so as to prevent the pad 65 from easily falling out of the pocket 63. The pads 65 are removable. As such, the pads 65 also can assume many shapes, sizes, thicknesses, and configurations, some of which are shown in FIGS. 7A-O. Pads 65 of different thicknesses and/or materials can be inserted into the pocket 63 to provide a range of varying targeted compression in a variety of locations and directions. By providing the pocket 63, the pad 65 is prevented from easily moving with respect to the garment 10 or becoming separated from the garment 10 unintentionally. As will be described below, the removable pads 65 enable a user to tailor the fit, comfort, and the amount and location of targeted compression provided by the garment 10. As an example, thicker pads 65, when inside pocket 63, can provide more medial compression than thinner pads 65, all else being equal.

Similarly, referring to FIGS. 3-4, 6A, and 8-10, the right wing 70 includes one or more features that are configured to provide the desired localized, targeted compression in a medial and/or in a cephalad-medial direction. In some embodiments, the right wing 70 includes a pocket 73 having a pocket opening 74. The pocket 73 can be a separate pocket sewn into the right wing 70, or alternatively can be simply a cavity (bounded by seams) located in between two layers that make up the right wing 70. The pocket 73 is located on the right wing 70 such that it overlies at least a portion of the lateral surface of a breast of a user when the garment 10 is worn. The pocket 73 is sized to receive a pad 75 therewithin. The pad 75 is insertable through the pocket opening 74. The pocket opening 74 can, if desired, include a closure mechanism 74*a* (e.g., a snap, zipper, hook/loop material, hook/eye, overlapping flap, and so forth). However, this is not required, and in the preferred embodiment the pocket opening 74 does not have a separate closure mechanism 74*a*, but rather the pocket opening 74 itself provides adequate retention of the pad 75 therewithin. The pocket opening 74 can be located generally at any location on the right wing 70, but in the preferred embodiment the opening 74 is located at the superior end of the pocket 73 so as to prevent the pad 75 from easily falling out of the pocket 73. The pads 75 are removable. As such, the pads 75 also can assume many shapes, sizes, thicknesses, and configurations. Pads 75 of different thicknesses and/or materials can be inserted into the pocket 73 to provide a range of varying targeted compression. By providing the pocket 73, the pad 75 cannot easily move with respect to the garment 10 or become separated from the garment 10 unintentionally. The removable pads 75 enable a user to tailor the fit, comfort, and the amount and location of targeted compression provided by the garment 10. As an example, thicker pads 75, when inside pocket 73, can provide more medial compression than thinner pads 75, all else being equal.

The location of the pockets 63, 73 impacts the ability of the garment 10 to provide the desired targeted, localized compression on the user's left and right breasts, respectively. In general, the location of the pockets 63, 73 can depend on many factors, including various dimensions of the user's chest, torso, and breasts; the dimension of the user's distance between that user's coronal plane midline axis and the beginning of that user's breast cavity; as well as the size and shape of the pads. For example, for two users who have the same breast projection measurement, the desired location for the pockets 63, 73 might depend in part on the relative bust measurements of the users, as well as the relative height and/or width of the user's breasts, among others. Additionally, to provide the desired localized, targeted medial components of compression to the user's breasts in order to maintain adequate force and pressure on the breasts to retain the implants within the relative capsules, it is helpful for the pockets 63, 73 not to be located circumferentially too far posteriorly (toward the rear) of the torso. Similarly, it is helpful for the pockets 63, 73 not to be located circumferentially too far anteriorly (toward the front) of the torso. The pockets 63, 73 each have a length (measured in a transverse plane, extending circumferentially) and a height (measured in a coronal plane, extending in a cephalad-caudal direction). In many embodiments, the pockets 63, 73 begin generally at the coronal plane midline axis (shown as a dashed vertical line in FIGS. 5A-C, 6A-C, 8, 9, 10, and 12B) or slightly anteriorly thereof. Each user has a coronal plane midline axis, which as used herein is akin to an imaginary plane separating the user's anterior or ventral side from his/her posterior or dorsal side. In addition, when viewing a person from the side, each user has a natural breast cavity location. The breast tissue is generally located on the chest over the pectoralis major muscle and extends medially-laterally from the edge of the sternum out to the midaxillary line (the center of the axilla or underarm). As used herein, the lateral extent of each breast is usually discernible and palpable at the intersection of the chest wall and the breast cavity itself. This location, as stated, is typically easy to locate by palpation where the firm feel of the chest wall gives way to the softer feel of the cavity where the breast tissue resides (for non-surgical patients) or where the capsule forms (for mastectomy patients). For most women, the beginning of the breast cavity is located slightly anteriorly of the coronal plane midline axis. For purposes of the garment 10, the pockets 63, 73 can typically have a first end thereof that is located in a range of from approximately the coronal plane midline axis to approximately the beginning of the breast cavity/capsule. This distance can vary with users, as discussed above. The examples provided herein indicate that some variation exists in the distances between various users' respective coronal plane midline axes and the beginning of their breast cavities/capsules.

The pockets 63, 73 then extend anteriorly from their beginning points, respectively, and terminate at a distance therefrom. The total length of the pockets 63, 73 depends on many factors, including various dimensions of the user's chest, torso, and breasts; the projection of the breast (that is, the distance a breast extends from the base of the breast cavity); and the relative height and width of the breast itself; as well as the size and shape of the pads. In general, the termination point for the pockets 63, 73 (i.e., the end opposite the beginning of the pockets 63, 73) can be in a range of from approximately 2 cm anterior of the beginning of the breast cavity or capsule to a distance that is approximately 60 percent of the length of the breast projection. For example, for two users who have the same breast projection measurement but whose breasts are vastly different in overall width might need different length pockets 63, 73 to house different length pads 65, 75. Relatedly, two users who have similar size busts but vastly differing breast projections will likely need different length pockets 63, 73. Notably, the lengths of the pads 65, 75 relate to the length of the pockets 63, 73, as, obviously, a pocket needs to be long enough to accept a given pad. Therefore, as used herein, the measurements of the example patients were obtained for the pads themselves, not the pockets for containing those pads. The pockets 63, 73 can obviously be larger than the pads 65, 75 they house, and the excess room in the pocket is typically not a problem unless the excess room is significant enough as to allow substantial pad migration within the pocket. In the preferred embodiment, zero to insignificant amounts of migration of the pads 65, 75 within the pockets 63, 73 is desired, so the pockets 63, 73 are sized just slightly larger than the pads 65, 75. The examples provided herein indicate that some correlation exists in the desired length of pads 65, 75 for users of varying breast and torso measurements, based on a percentage of breast projection. And, because the breasts reside within the cups 20, 30, this translates to a percentage of the cup length projections 20*b*, 30*b* (i.e., the length of the cups 20, 30, respectively). FIGS. 5A, 6A, 8, and 9 show points P1 and P2, which indicate points that are anteriorly spaced from the garment midline axis 13 at a distance of approximately 60 percent of the cup length projections 20*b*, 30*b*, respectively.

Example 1 was a radical bilateral mastectomy patient with replacement silicon breast implants who wears a size 36D bra. The breast projection, measured as the distance from the base of the breast cavity/capsule to the outermost extent of the breast was 13.2 cm. The distance between the coronal plane midline axis and the base of the breast cavity/capsule was 6.0 cm. The preferred pad 65, 75 length was 7 cm and began at approximately the base of the breast cavity. This means that the anterior-most extent of the pad 65, 75 was located at an anterior location that was approximately 53% of the breast projection (i.e., 7 cm divided by 13.2 cm equals 53%). Example 2 was a bilateral breast augmentation patient with silicon implants who wears a size 34D bra. The breast projection was 10.0 cm. The distance between the coronal plane midline axis and the base of the breast cavity/capsule was 5.0 cm. The preferred pad 65, 75 length was 6 cm and began at approximately the base of the breast cavity. This means that the anterior-most extent of the pad 65, 75 was located at an anterior location that was approximately 60% of the breast projection (i.e., 6 cm divided by 10.0 cm equals 60%). Example 3 was a radical bilateral mastectomy patient with replacement silicon breast implants who wears a size 36C bra. The breast projection was 10.5 cm. The distance between the coronal plane midline axis and the base of the breast cavity/capsule was 5.5 cm. The preferred pad 65, 75 length was 6 cm and began at approximately the base of the breast cavity. This means that the anterior-most extent of the pad 65, 75 was located at an anterior location that was approximately 57% of the breast projection (i.e., 6 cm divided by 10.5 cm equals 57%). In Table 1 below, data for just one breast is included, as data for the other breast was similar, accounting for anatomical anomalous factors.

TABLE 1

| Pt. | Band | Bust | Region height | Breast projection | Breast width | Breast height | Midline to Breast | Preferred pad length |
|---|---|---|---|---|---|---|---|---|
| 1 | 84.0 | 104 | 35 | 13.2 | 13.7 | 13.7 | 6.0 | 7 |
| 2 | 79.5 | 95.2 | 30 | 10.0 | 14.7 | 13.5 | 5.0 | 6 |
| 3 | 77.0 | 96.5 | 31 | 10.5 | 14.0 | 17.1 | 5.5 | 6 |

With all three example patients, the preferred pad lengths were based on user preference based on maximum length that was tolerated based on comfort. Shorter length pads were possible for each patient, but maximum length recorded indicates the longest pad each patient felt comfortable using, while starting at the base breast cavity, without having too much of the pad be visible from the front. Therefore, the maximum overall length of a pad for likely comfort and desirability, while also providing the desired medial force and compression on the breast is obtained by adding the preferred pad length to the distance from the coronal plane midline axis. This is because theoretically the pads 65, 75 could begin at such midline and extend all the way to a point that is approximately 60% of the overall breast projection (60% of the cup length projection). So, for patient 1, the theoretical maximum pad length is 13 cm; for patient 2 is 11 cm; and for patient 3 is 11.5 cm. In preferred embodiments, however, the pads 65, 75 would generally not be this long because of the discomfort of wearing a pad 65, 75 directly beneath the armpit. Therefore, preferably, the pads 65, 75 start at a point that is anterior of the midline, and most preferably start at approximately the base of the breast projection. So, the preferred pad length for patient I was 7 cm, and it started at approximately 6 cm anterior of the midline. The preferred pad length for patient 2 was 6 cm, and it started at approximately 5 cm anterior of the midline. The preferred pad length for patient 3 was 6 cm, and it started at approximately 5.5 cm anterior of the midline. Pads of these ranges of lengths, located in pockets positioned to house pads in these ranges of positions, provide the desired targeted, localized medial components of compression to the users' breasts.

With reference to the figures, and in particular FIG. 7A-70, as stated, the pads 65, 75 can take on a variety of shapes, sizes, and thicknesses. In many embodiments, each pad 65, 75 typically will have a substantially planar configuration, having a first outer surface 66, 76, respectively, and a second outer surface 67, 77, respectively. Each pad 65, 75 typically will have an average thickness 68, 78, respectively, measured between each first outer surface 66, 76 and each second outer surface 67, 77, respectively. Each pad 65, 75 typically will have an overall length, overall height, and overall thickness. The overall shape can be any of a number of shapes commonly used for padding for various purposes related to wearable garments. FIGS. 7A-70 depict several non-limiting examples, which can include triangular, rectangular, square, pentagonal, hexagonal, oval, circular, star-shaped, cup-shaped, regular polygonal, non-regular polygonal, anatomically curved, regular, irregular, and any other geometric shape that can used for a pad. The overall length of each pad 65, 75 is simply measured along the longest dimension of the first outer surface 66, 76. Similarly, the overall height of each pad 65, 75 is simply measured along the shortest dimension of the first outer surface 66, 76. The average thickness 68, 78 of each pad 65, 75 is measured between the first outer surface 66, 76 and the second outer surface 67, 77 of each pad 65, 75. It is possible that the pads 65, 75 in some embodiments might not be substantially planar in shape, but might have varying and/or more complicated dimensions, including varying thicknesses. For example, the pads 65, 75 could be contoured in various ways, with some areas that are thicker than other areas. As some non-limiting examples, the pads 65, 75 could be wedge-shaped, hourglass, cuboid, polygonal prismatic, conical, parallelepiped, dog-bone, cylindrical, pyramidal, irregular 3-D, and so forth, some of which are shown in FIGS. 7A-70. As will be discussed below, the overall size and shape of the pads 65, 75 can vary, depending on many factors, including the size of the garment 10, the size of various metrics of the user (including, but not limited to, chest, bust, cup, shoulder, and torso measurements); the location of the pockets 63, 73 and the pocket openings 64, 74; and the desired location of the pads 65, 75 to apply appropriate pressure to desired locations of the breast region of the user. In a preferred embodiment, the pads 65, 75 are generally rectangular in shape but have an arc removed from the anterior end (as worn). This cutout minimizes the visibility of the pad 65, 75 through the garment 10. In general terms, the overall length of the pads 65, 75 can vary from approximately 2 cm to approximately 21 cm, and preferably is in the range of approximately 5 cm to approximately 10 cm. The overall height of the pads 65, 75 can vary from approximately 2 cm to approximately 13 cm, and preferably is in the range of approximately 5 cm to approximately 10 cm. For embodiments using substantially planar pads, the pads 65, 75 can range in thickness from approximately 1 mm to approximately 5 cm, and preferably is in the range of approximately 5 mm to approximately 2 cm. And, as stated above, for pads 65, 75 having non-planar configurations, various portions of the pads 65, 75 can have substantially greater thicknesses than other portions of the pads 65, 75. Indeed, in some embodiments, the pads 65, 75 can have multiple sections, where a first section is, as an example, insertable into a front pocket 28, 38 (FIG. 3) to provide a smooth front breast outline, but a second section that resides at, near, or within pocket 63, 73 to provide the desired medial compression to the left and right breast, respectively (see, e.g., FIG. 7M).

An added benefit of providing pockets 63, 73 is that pads 65, 75 can be removed at will by the user. And, the user can utilize different pads 65, 75 to apply different amounts of medial and/or cephalad-medial and/or caudal-medial compression to the breasts. If a given pad 65, 75 does not provide the desired medial or cephalad-medial or caudal-medial compression, that pad can be removed and a different pad 65, 75 having a greater thickness 68, or perhaps having a different cross-sectional shape, or having a different material composition, can be inserted in the pockets 63, 73, respectively. The pads 65, 75 can be made of numerous materials suitable for use in a wearable garment, as discussed further below. And, the amount and/or direction of medial and/or cephalad-medial and/or caudal-medial compression provided by the pads 65, 75 is determined in part not only by the size and shape of the pads 65, 75, as discussed above, but also by the material that makes up the pads 65, 75. For example, a given pad of a first foam material might not provide as much medial compression as a pad of a denser foam material, for a given thickness.

Figure 12A:
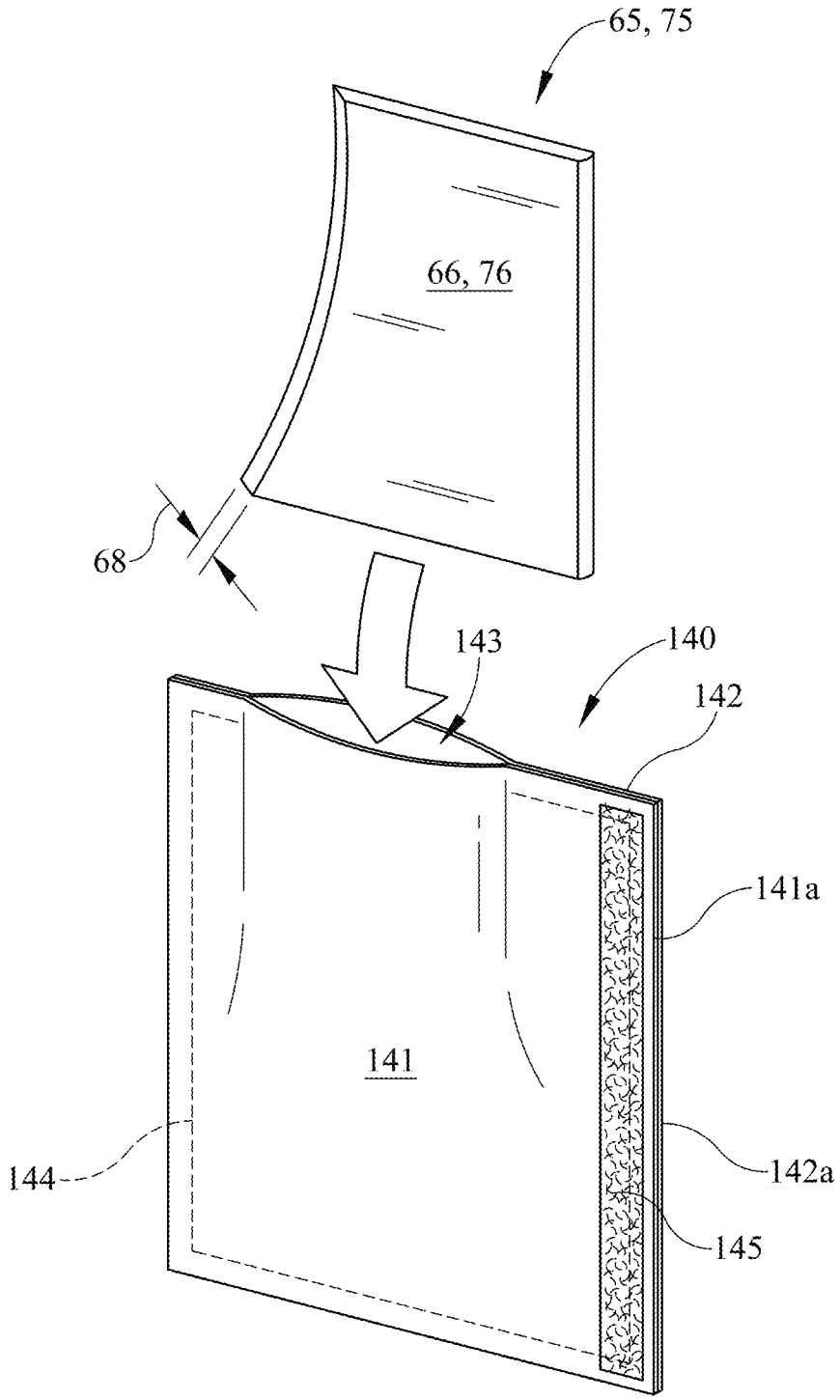
FIG. 12A is a schematic of a sleeve and a pad according to an embodiment.

In embodiments of garment 10 that do not include pockets 63, 73, it is still possible to utilize pads 65, 75 to provide the desired targeted, localized compression for the breasts as described herein. As shown in FIG. 12A, a sleeve 140 is provided that receives a pad 65, 75. The sleeve 140 serves a similar function as the pockets 63, 73, with the exception that the sleeve 140 is modular in that it can be removably coupled to any garment. The sleeve 140 is generally a pocket-like item having a first surface 141 with a perimeter 141*a* and a second surface 142 with a perimeter 142*a*. Numerous materials can be used for the sleeve 140, including any of the materials that are commonly used in bras or other undergarments worn by humans that do not irritate the skin or cause other problems with outer clothing. Examples of such materials include those discussed further below. The shape of the first surface 141 and second surface 142 can be any of a number of shapes, including, but not limited to, any of the shapes described above with regard to the pads 65, 75. For the sake of simplicity, the figures depict a simple rectangular shaped sleeve 140, which is the preferred embodiment. The perimeter 141*a* can be joined to perimeter 142*a* in various ways, such as, for example, sewing, heat welding, and any other commonly known methods of joining material. For maximum utility, a portion of the perimeter 141*a* and 142*a* is not joined, so as to create an opening 143 therein that provides access to an inner pouch 144 configured to receive a pad 65, 75. The opening 143 allows a user to insert and remove any of the various types, shapes, and sizes of pads 65, 75 as desired. Alternatively, the sleeve 140 can also be a closed sleeve 140 that does not include an opening 143. In such a closed sleeve 140, a particular pad 65, 75 is inserted into the inner pouch 144 and the perimeters 141*a*, 142*a* are sealed around the pad 65, 75. This sleeve 140 functions identically as does the sleeve 140 described above, with the only exception being a user cannot easily remove and reinsert different pads 65, 75 into the inner pouch 144.

Figure 12B:
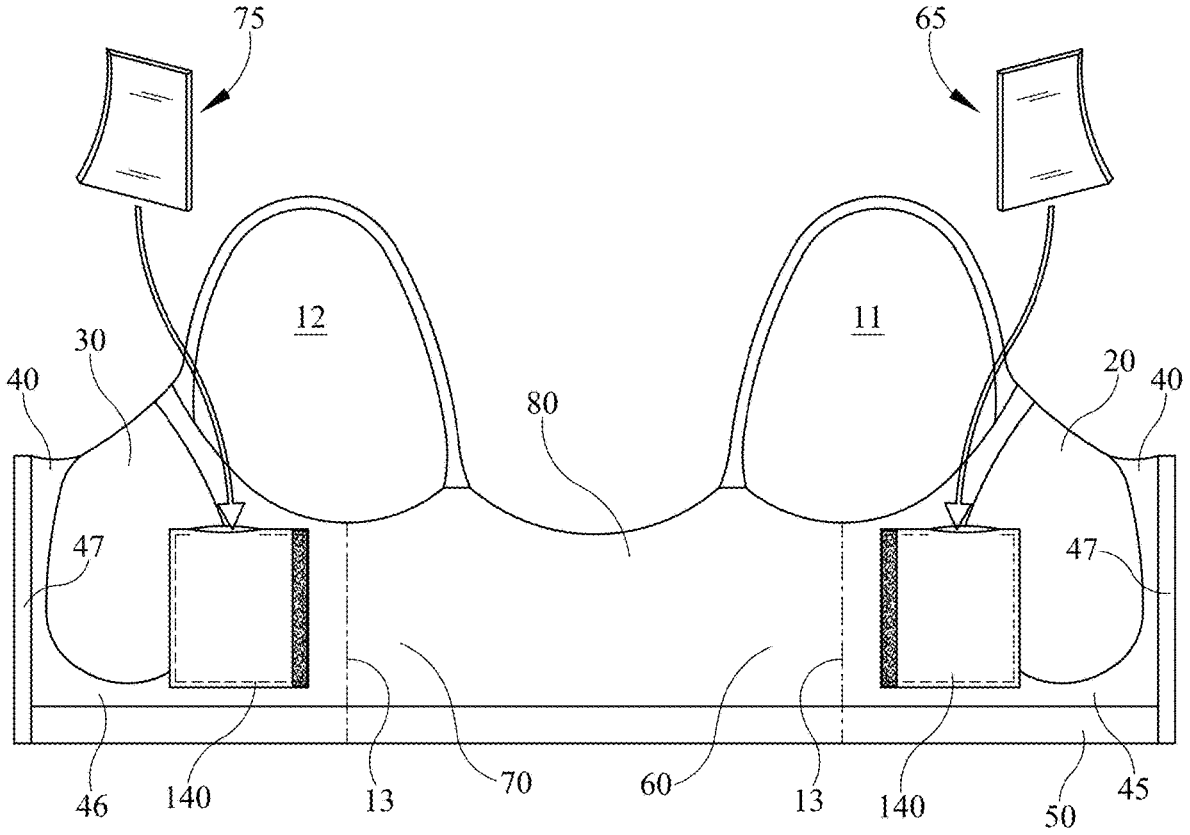
FIG. 12B is a front view of the inside of a bra laid open flat showing a representative location for a sleeve according to an embodiment.

The sleeve 140 can be coupled to any garment in locations so as to provide the desired targeted, localized compression. These locations correlate to those described above in reference to the pockets 63, 73. For example, the sleeve 140 can be sewn into a garment at a location that will, when worn by a user, apply targeted, localized compression to a breast. Such locations are generally located similarly as discussed above with respect to the pockets 63, 73 and pads 65, 75. This is acceptable for users who are willing to sew (or otherwise substantially permanently couple) the sleeve 140 into their garment of choice. However, for more universal application, the sleeve 140 can also be removably coupled into a garment at such locations, so that a user can selectively employ/not employ the sleeve 140 within the garment. FIG. 12B depicts an embodiment of a sleeve 140 that is configured for removable coupling into a garment. The sleeve 140 can be fitted with one or more removable coupling devices 145, such as, for example, zippers, hook and loop, hook and eye, buttons, snaps, clasps, magnets, rings, post and receiver, and any other form of male/female closure coupling devices suitable for fabric in a garment. In particular, the sleeve 140 can be fitted with a first portion of the coupling device 145 (e.g., the male portion) and the garment can be fitted with a second portion of the coupling device 145 (e.g., the female portion).

In the embodiment shown in FIG. 12B, the female portion of the hook-and-loop coupling device 145 (i.e., the loop) is adhered to the inside of a garment at or near the left wing 60, lower band 50, or right wing 70, as desired. The reason for this is that the loop portion is typically softer and less prone to causing chafing, poking, or other irritation to the user if the user wears the garment without the mating male portion (described below). The user can determine the location for the sleeve 140 as discussed herein and locate the coupling device 145 accordingly so as to achieve the desired targeted, localized compression. The embodiment shown in FIG. 12B includes only a single coupling device 145, shown along a perimeter 141*a*, 142*a* of the sleeve 140. However, any number of coupling devices 145 can be used as desired, and the locations of such can vary. For example, four coupling devices 145 can be used, and they can be located anywhere along the perimeter 141*a*, 142*a* of the sleeve 140 (e.g., at the corners, at midpoints, at random locations, etc.). In the depicted embodiment, the female portion (i.e., the loop) of the coupling device 145 is coupled to the garment via adhesive. This can be an adhesive-backed loop portion, or can be a separate adhesive applied to the loop portion. Any of the other forms of fastening the female portion to the garment (that is, fastening two fabrics together) described herein are possible, including sewing. Adhesives are preferred, however, because they are easier to install and less permanent than sewing.

Similarly, in the embodiment shown in FIG. 12B, the male portion of the hook-and-loop coupling device 145 (i.e., the hook) is adhered to a perimeter 141*a*, 142*a* of the sleeve 140. In the depicted embodiment, only one male portion is shown, but obviously any number and location of male portions are possible, arranged to align with the female portions located on the garment. Once the mating portions of the coupling device 145 are adhered to the garment and sleeve 140, respectively, the user can selectively install/uninstall a sleeve 140 (containing therewithin a pad 65, 75) into any garment. And, where the sleeve 140 has opening 143, the user can selectively remove/insert pads 65, 75 of varying shapes, sizes, and designs as desired. The location of the sleeve 140 is preferably arranged on the garment as described above with respect to pockets 63, 73 for garment 10. In this manner, a user who does not have garment 10 can still benefit from targeted, localized compression of her breasts by adding a sleeve 140 to any of her garments in the manner described herein.

Targeted Compression-Medial Compressors

Figure 5A:
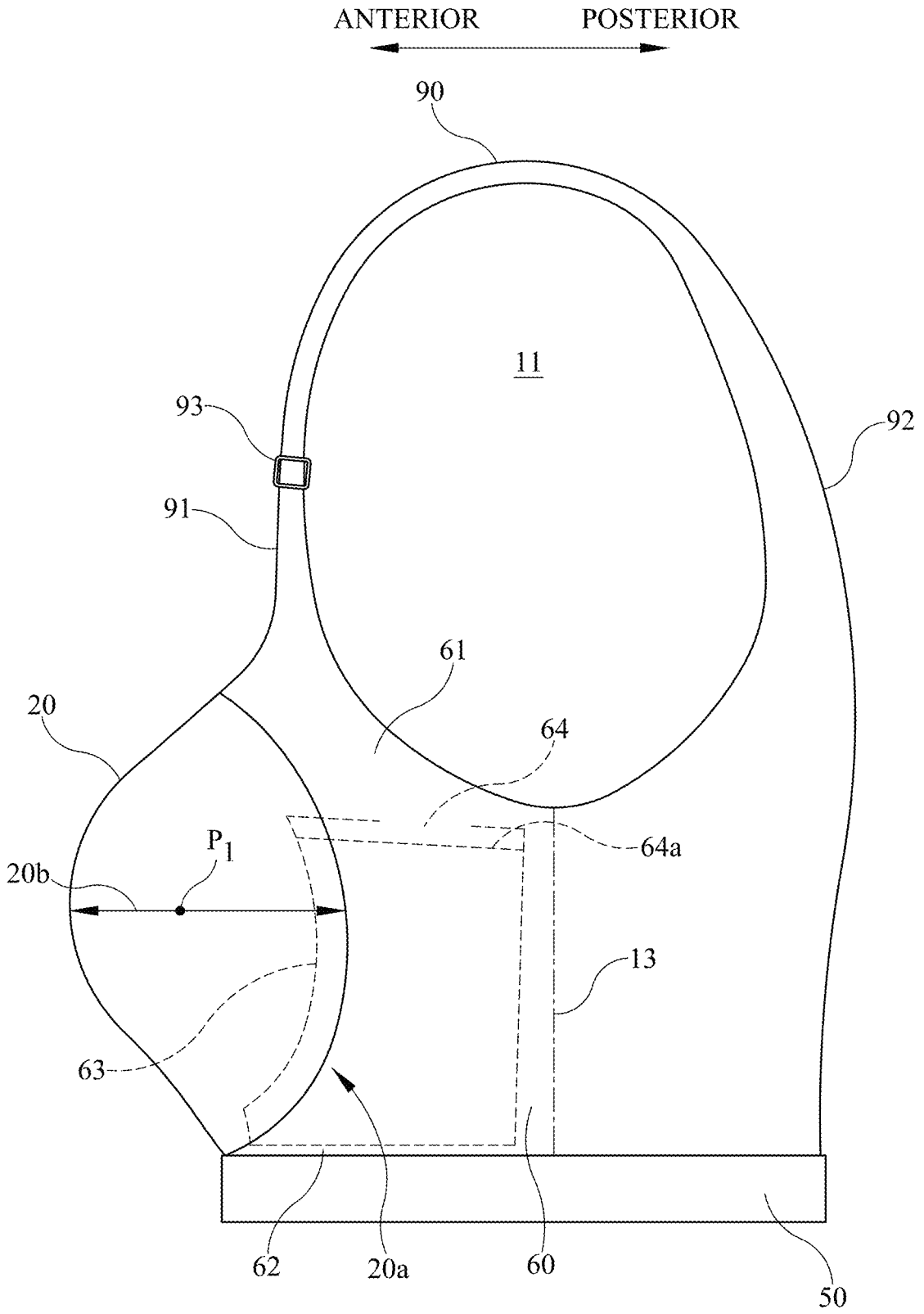
FIG. 5A is a left side exterior view of a support bra according to an embodiment, as it would be worn on a torso.
Figure 5B:
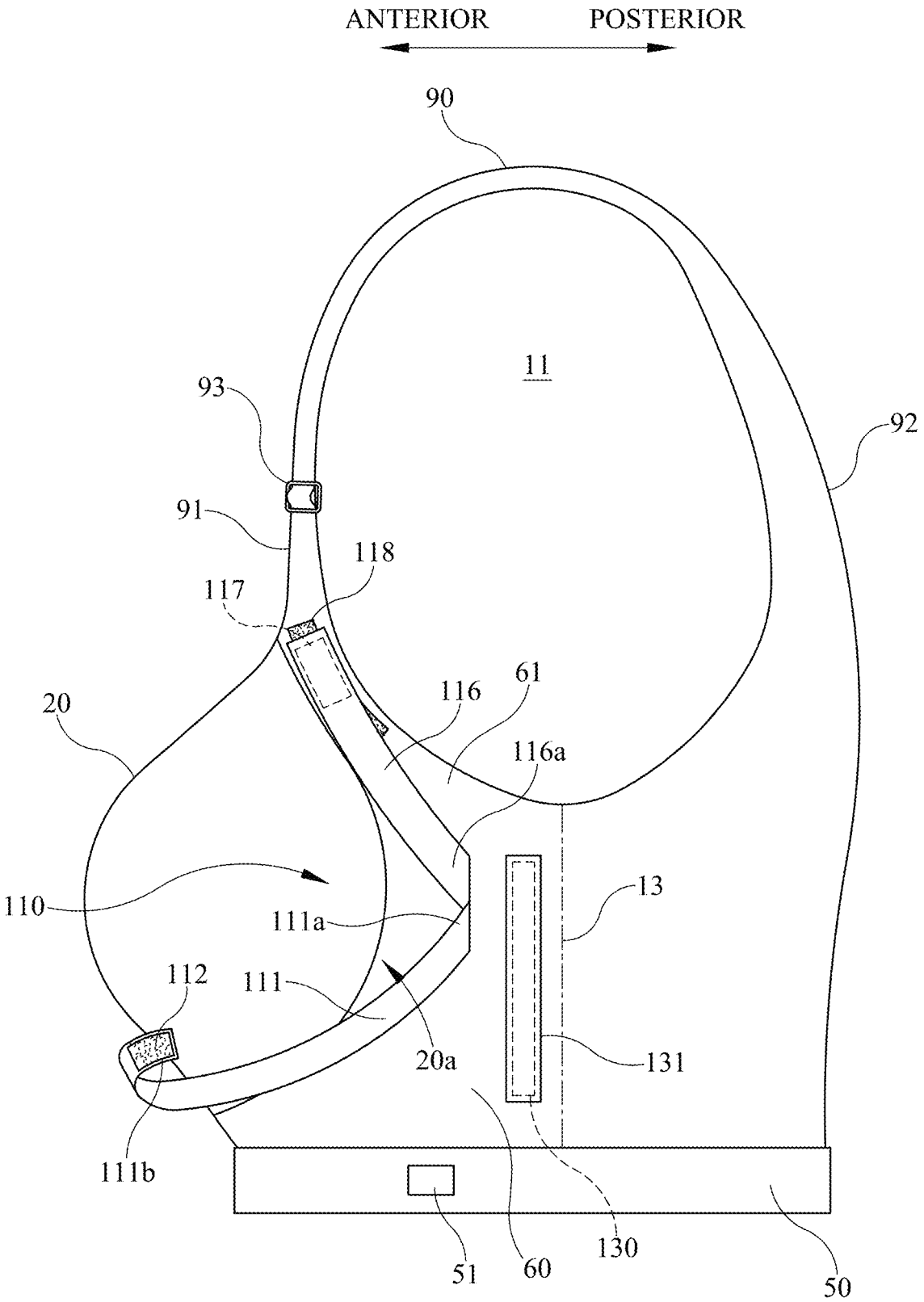
FIG. 5B is a left side exterior view of a support bra according to an embodiment, as it would be worn on a torso.
Figure 5C:
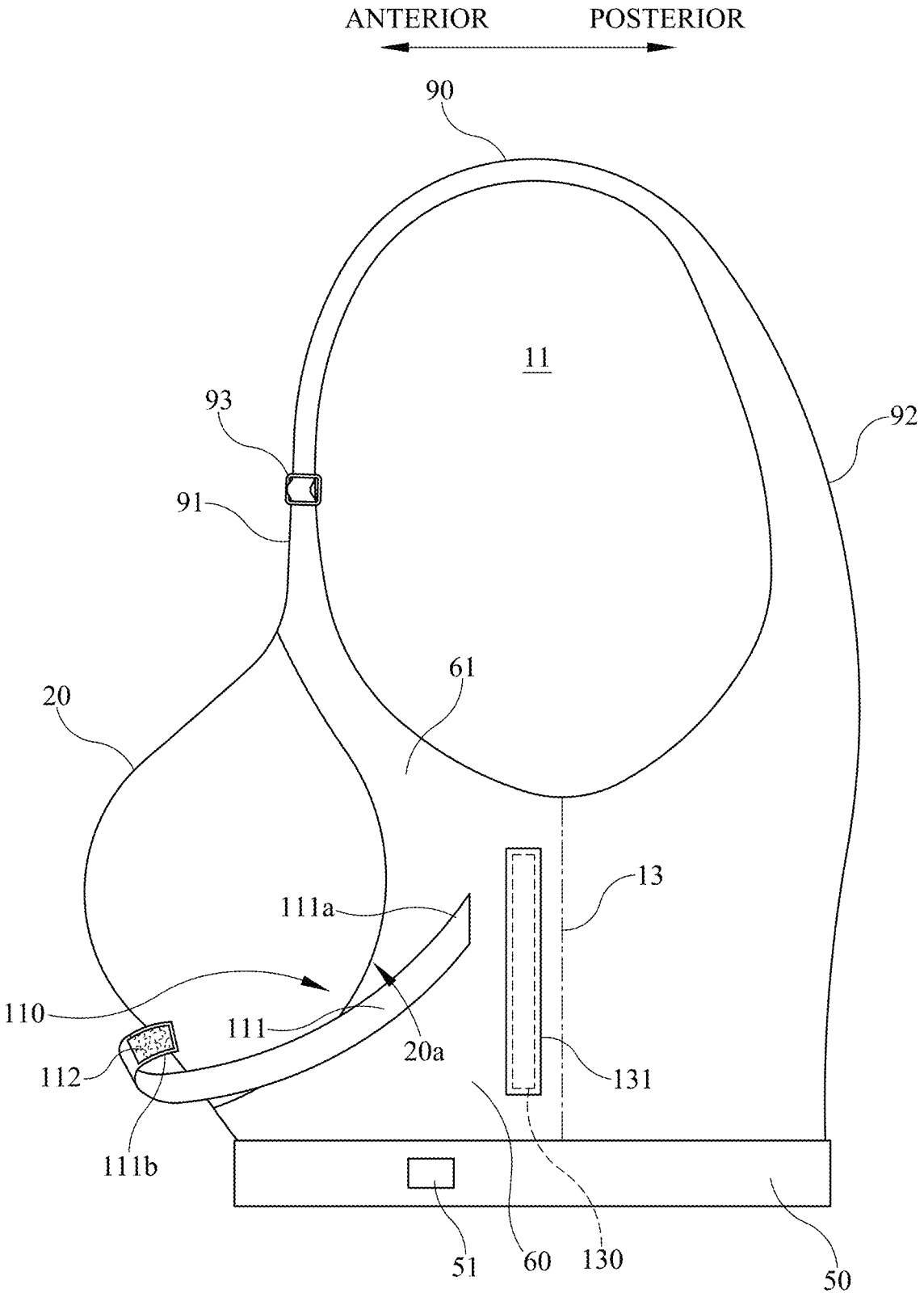
FIG. 5C is a left side exterior view of a support bra according to an embodiment, as it would be worn on a torso.
Figure 6A:
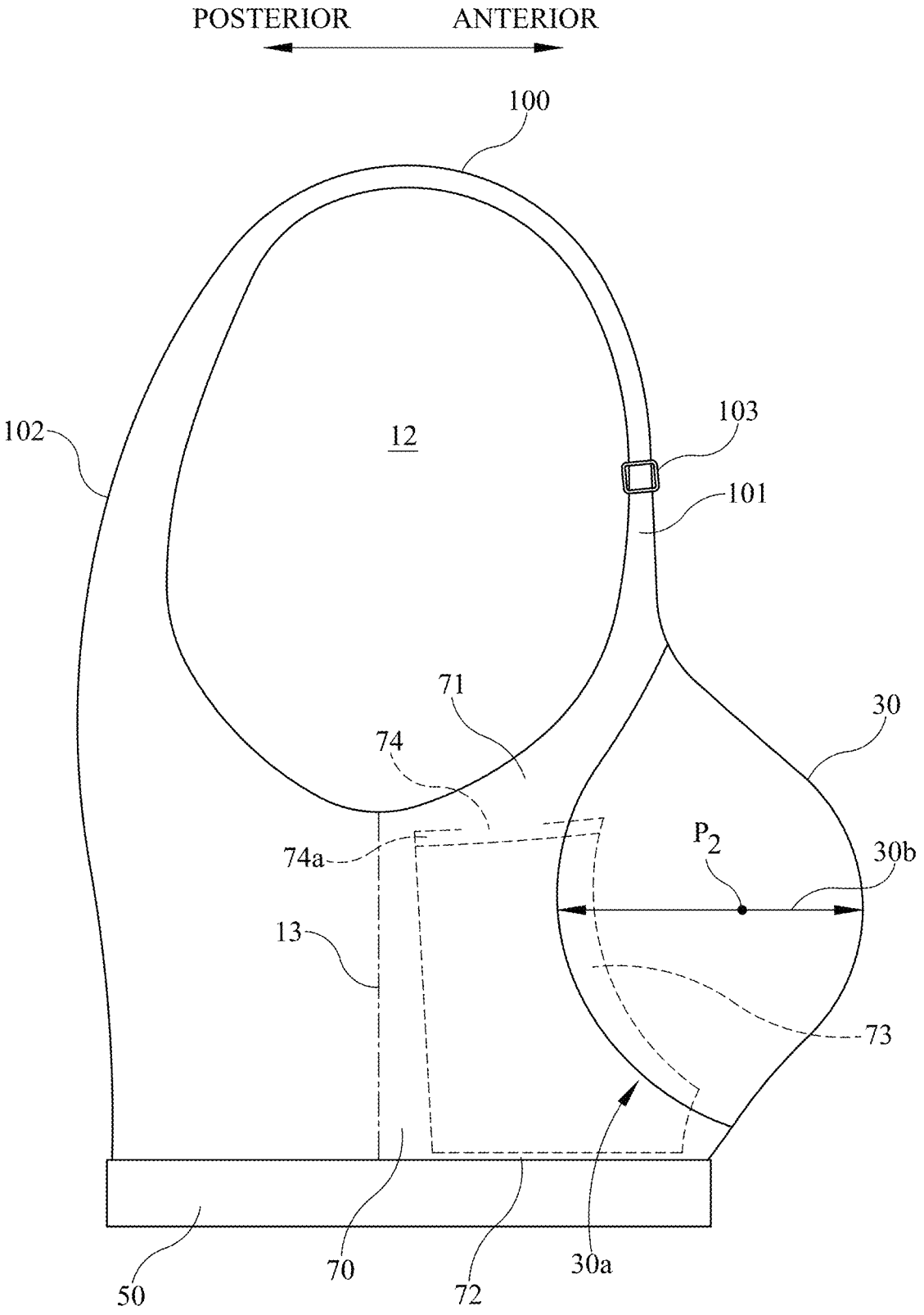
FIG. 6A is a right side exterior view of a support bra according to an embodiment, as it would be worn on a torso.
Figure 6B:
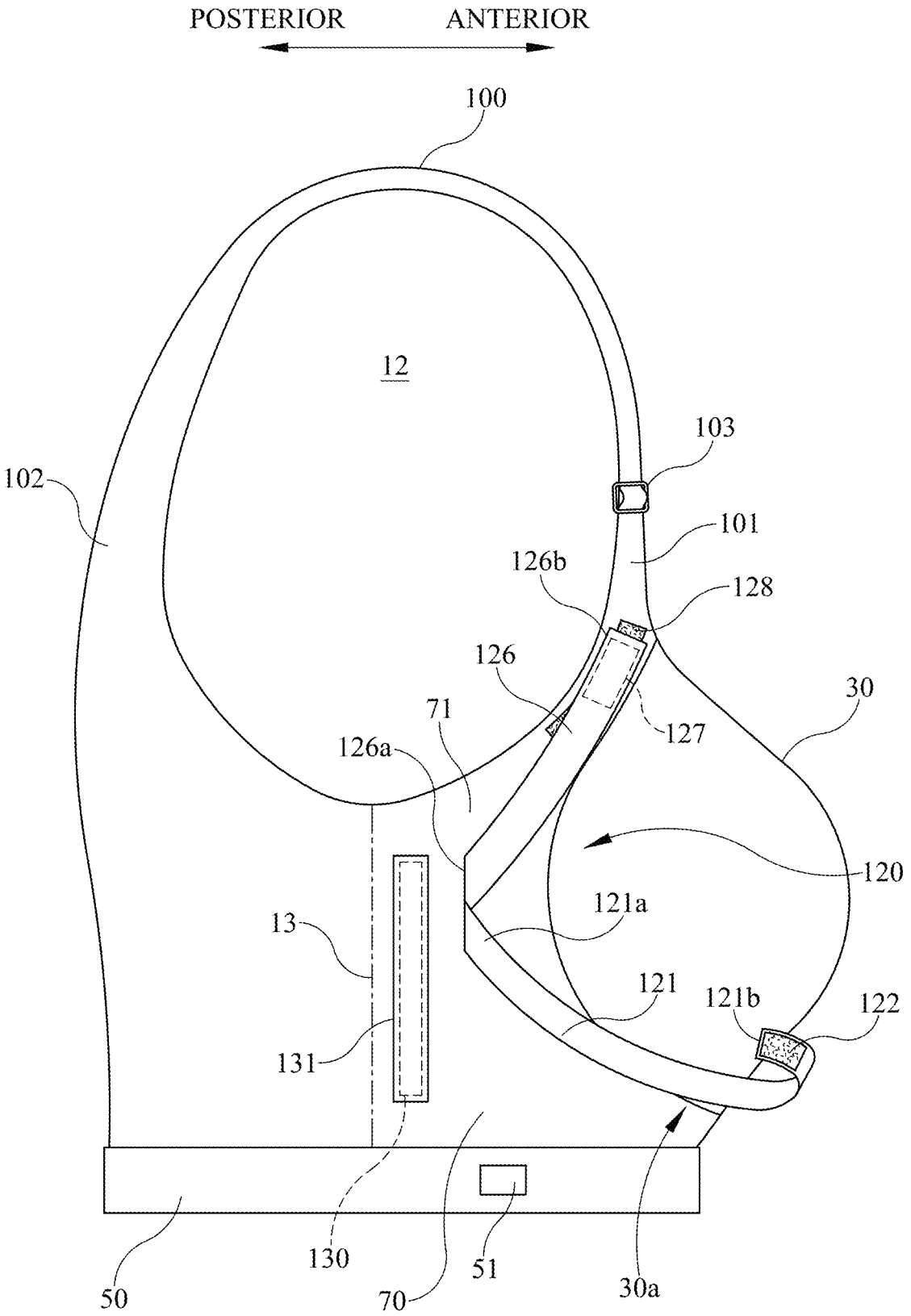
FIG. 6B is a right side exterior view of a support bra according to an embodiment, as it would be worn on a torso.
Figure 6C:
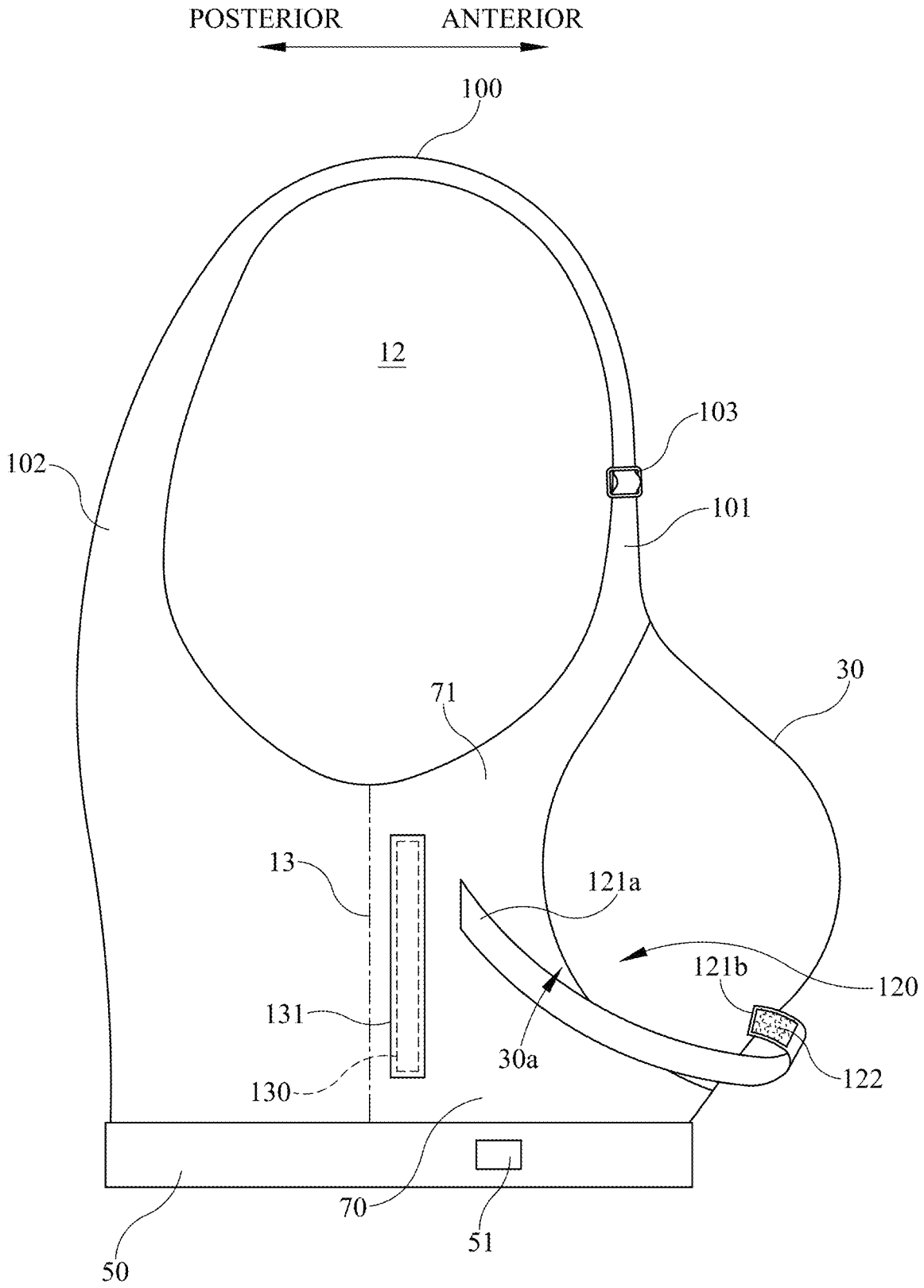
FIG. 6C is a right side exterior view of a support bra according to an embodiment, as it would be worn on a torso.

In other embodiments, the left wing 60 and/or right wing 70 may have an additional, or may have a different, feature or features that allow the user to apply targeted medial compression (and medial components of compression) to the breasts. FIGS. 2, 3, 5B, and 6B depict an embodiment wherein the left wing 60 may include a first medial compressor 110 according to a first embodiment and the right wing 70 may include a second medial compressor 120 according to a first embodiment. FIGS. 5C, and 6C depict an embodiment wherein the left wing 60 may include a first medial compressor 110 according to a second embodiment and the right wing 70 may include a second medial compressor 120 according to a second embodiment. The various targeted compression features (i.e., pockets with pads, sleeves with pads, and medial compressors) are not mutually exclusive. That is, the garment 10 may include pockets 63, 73 with pads 65, 75; or the garment 10 may include first and/or second medial compressors 110, 120; or the garment may include both features: pockets 63, 73 with pads 65, 75 and also first and/or second medial compressors 110, 120. Similarly, obviously, the garment 10 may include variations where either the left side or the right side of the garment omits such features, for example for a user who underwent a unilateral mastectomy with reconstruction.

First medial compressor 110 can take on various forms. FIG. 5B depicts a first embodiment of first medial compressor 110. In this preferred embodiment, the first medial compressor 110 includes a first strap 111 having a first end 111*a* and a second end 111*b* and a second strap 116 having a first end 116*a* and a second end 116*b*. With regard to the first strap 111, first end 111*a* is attached to the garment 10, preferably at the left wing 60, and preferably in a sagittal plane at or anteriorly to the coronal (frontal) midline of the user when the garment 10 is worn. The first end 111*a* of the first strap 111 is coupled to the garment 10 between a left arm opening 11 (discussed below) and a bottom portion of left wing 60, preferably at or near a central region or mid-height thereof. Second end 111*b* is a free end that includes a first fastener portion 112 thereon. First fastener portion 112 is configured to adjustably engage with a second fastener portion 113 that is coupled to a different location on the garment 10. Preferably, the second fastener portion 113 is coupled at or proximate to the lower band 50 or below the left cup 20. It should be understood that the configuration of the first strap 111 and the second fastener portion 113 can be reversed, wherein the second fastener portion 113 is coupled to the left wing 60 and the first end 111*a* of the first strap 111 is coupled to the lower band 50 or the left cup 20. Also, second fastener portion 113 could comprise a loop through which the second end 111*b* of the first strap 111 is inserted, and then the second end 111*b* is then brought back over the first end 111*a* of the first strap 111 to fasten onto itself (e.g., as with mating hook/loop material). As will be understood, the type of first strap 111 and the type and location of the mating structures thereon will have input into how, and how much, adjustment of the first strap 111 is achieved. As but one example, a longer first strap 111 having a longer section of hook/loop material thereon will provide more adjustment (length and compression) to the first strap 111 than would a shorter first strap 111 and/or a shorter section of hook/loop material thereon.

Also, it should be understood that the first strap 111 and its adjustability can assume other structures as well. As one example, the first strap 111 can be of a type similar to that of typical bra straps (e.g., left strap 90) and can have a length adjuster similar to adjuster 93 that provides a user with the ability to adjust the length of the first strap 111, and therefore also the amount of tension in the first strap 111, which adjusts the amount of compression applied to the left breast. For such embodiment, the first end 111*a* and second end 111*b* would be fastened (typically, sewn) into the garment 10 in locations as described above. The user would increase the compression applied to the left breast by shortening the length of the first strap 111, and would decrease the compression applied to the left breast by lengthening the first strap 111. The first strap 111 can be on the exterior of the garment 10 (as shown in the figures) or can be located on an interior of the garment 10 so as to be less visible when the garment 10 is worn underneath clothes. In such interior arrangements, the first strap 111 can, for example, be fitted inside a sleeve sewn on the inside of the left cup 20, left wing 60, center panel 40, etc. The first fastener portion 112 and second fastener portion 113 would obviously be modified according to this physical arrangement such that the user can adjust the tension in the first strap 111 by fastening to an interior surface of the garment 10 rather than an exterior surface of the garment 10. Alternatively, the first strap 111 can still be situated on external surfaces of the garment 10 (as shown in the figures), but could be covered with additional material or sleeves or flaps so as to provide a smoother external appearance when the garment 10 is worn under other clothing. Alternatively, the first strap 111 can itself be padded or made from a padded material, as opposed to simply from an elastic material. Alternatively, in either external or internal locations, the first strap 111 can be in the form of a drawstring that is inserted into and anchored within a pocket within the garment 10. Such drawstring can be akin to commonly known drawstrings present in other garments, such as sweatpants, hooded sweatshirts, coats, and the like. The drawstring can be fitted with a stopper on an end thereof that can fasten to the drawstring at various locations therealong, thereby altering a length of the drawstring, and thus enabling a user to adjust the tension in the first strap.

With regard to the second strap 116, first end 116*a* is attached to the garment 10, preferably at the left wing 60. The first end 116*a* of the first strap 111 is coupled to the garment 10 between a left arm opening 11 (discussed below) and a bottom portion of left wing 60, preferably at or near a central region or mid-height thereof and preferably in a sagittal plane at or anteriorly to the coronal (frontal) midline of the user when the garment 10 is worn. Second end 111*b* is a free end that includes a first fastener portion 117 thereon. First fastener portion 117 is configured to adjustably engage with a second fastener portion 118 that is coupled to a different location on the garment 10. Preferably, the second fastener portion 118 is coupled at or proximate to the upper, cephalad region 26 of the left cup 20 or the left strap 90. It should be understood that the configuration of the second strap 116 and the second fastener portion 118 can be reversed, wherein the second fastener portion 118 is coupled to the left wing 60 and the first end 116*a* of the second strap 116 is coupled to the left strap 90 or the left cup 20. Also, second fastener portion 118 could comprise a loop through which the second end 116*b* of the second strap 116 is inserted, and then the second end 116*b* is then brought back over the first end 116*a* of the second strap 116 to fasten onto itself (e.g., as with mating hook/loop material). And, as discussed above with regard to first strap 111, the type of second strap 116 and the type and location of the mating structures thereon will have input into how, and how much, adjustment of the second strap 116 is achieved. As but one example, a longer second strap 116 having a longer section of hook/loop material thereon will provide more adjustment (length and compression) to the second strap 116 than would a shorter second strap 116 and/or a shorter section of hook/loop material thereon.

Also, it should be understood that the second strap 116 and its adjustability can assume other structures as well. As one example, the second strap 116 can be of a type similar to that of typical bra straps (e.g., left strap 90) and can have a length adjuster similar to adjuster 93 that provides a user with the ability to adjust the length of the second strap 116, and therefore also the amount of tension in the second strap 116, which adjusts the amount of compression applied to the left breast. For such embodiment, the first end 116*a* and second end 116*b* would be fastened (typically, sewn) into the garment 10 in locations as described above. The user would increase the compression applied to the left breast by shortening the length of the second strap 116, and would decrease the compression applied to the left breast by lengthening the second strap 116. The second strap 116 can be on the exterior of the garment 10 (as shown in the figures) or can be located on an interior of the garment 10 so as to be less visible when the garment 10 is worn underneath clothes. In such interior arrangements, the second strap 116 can, for example, be fitted inside a sleeve sewn on the inside of the left cup 20, left wing 60, etc. The first fastener portion 117 and second fastener portion 118 would obviously be modified according to this physical arrangement such that the user can adjust the tension in the second strap 116 by fastening to an interior surface of the garment 10 rather than an exterior surface of the garment 10. Alternatively, the second strap 116 can still be situated on external surfaces of the garment 10 (as shown in the figures), but could be covered with additional material or sleeves or flaps so as to provide a smoother external appearance when the garment 10 is worn under other clothing. Alternatively, the second strap 116 can itself be padded or made from a padded material, as opposed to simply from an elastic material. Alternatively, in either external or internal locations, the second strap 116 can be in the form of a drawstring that is inserted into and anchored within a pocket within the garment 10. Such drawstring can be akin to commonly known drawstrings present in other garments, such as sweatpants, hooded sweatshirts, coats, and the like. The drawstring can be fitted with a stopper on an end thereof that can fasten to the drawstring at various locations therealong, thereby altering a length of the drawstring, and thus enabling a user to adjust the tension in the first strap.

In this configuration of the first medial compressor 110, the first strap 111 and second strap 116 can be used and adjusted to apply targeted, localized compression along each of their lengths, respectively, to provide an enveloping "cupping" support for the left breast. This cupping support serves to not only retain the left breast in position, but also to provide a component of a medial force on the left breast, a partially cephalad force on the lower side of the left breast, and a partially caudal force on the upper side of the left breast. In doing so, the first strap 111 and second strap 116 serve to "push" the left breast medially or partially medially, and in some cases anteriorly and maintain the implant properly in the breast capsule for proper healing and/or to maintain the breast properly in the breast cavity for a desired full or "push-up" appearance. For example, the first strap 111 can apply a compression force to the left breast in a medial-cephalad direction and such compression can be adjusted by adjusting the length or tension in the first strap 111 by moving the first fastener portion 112 relative to the second fastener portion 113. For example, the first strap 111 can be an elastic material, with first end 111*a* sewn at or near the left wing 60. The first end 111*a* can be at the coronal midline or anteriorly of it, and is shown anteriorly in the figures. The second end 111*b* has a first fastener portion 112 that matingly couples with the second fastener portion 113. The fastener portions can be any of a number of commonly used fasteners for garments such as garment 10, wherein one fastener portion (either 112 or 113) comprises a first component of a fastener, and the other portion (either 113 or 112) comprises the mating partner of the first component. Some examples include, but are not limited to, hook and eye, hook and loop, figure-8 type clasps, non-slip adjustable bra clips, mating rings, magnets, buttons/holes, snaps, various slides, and the like. The length of the first strap 111 and second strap 116, the amount of elasticity in the straps, the relative size, number, and position of the first fastener portions 112, 117 and second fastener portions 113, 118 all can contribute to the ability for a user to adjust the amount of tension in the first strap 111 and second strap 116, respectively, which in turn relates to the amount and direction of targeted, localized compression applied to the breast when the garment 10 is worn. This compression can manifest in actual movement of the breast in a medial and/or medial-cephalad direction and/or medial-caudal direction, or in a desired increased stress applied to the breast that beneficially keeps the implant properly within the breast cavity or capsule, with or without noticeable movement of the breast.

FIG. 5C shows a second embodiment of first medial compressor 110. In this embodiment, only first strap 111 is present. This embodiment might be useful for a person who either does not want or does not need the type of force applied by, and the resulting motion of the breast from, the second strap 116.

Referring again to FIGS. 2, 3, 5B, and 6B, second medial compressor 120 can be located on the right side of the garment 10 in order to provide the desired support for the right breast. The second medial compressor 120, like the first medial compressor 110, can take on various forms. FIG. 6B depicts a first embodiment of second medial compressor 120. In this preferred embodiment, the second medial compressor 120 includes a first strap 121 having a first end 121*a* and a second end 121*b* and a second strap 126 having a first end 126*a* and a second end 126*b*. With regard to the first strap 121, first end 121*a* is attached to the garment 10, preferably at the right wing 70, and preferably in a sagittal plane at or anteriorly to the coronal (frontal) midline of the user when the garment 10 is worn. The first end 121*a* of the first strap 121 is coupled to the garment 10 between a right arm opening 12 (discussed below) and a bottom portion of right wing 70, preferably at or near a central region or mid-height thereof. Second end 121*b* is a free end that includes a first fastener portion 122 thereon. First fastener portion 122 is configured to adjustably engage with a second fastener portion 123 that is coupled to a different location on the garment 10. Preferably, the second fastener portion 123 is coupled at or proximate to the lower band 50 or below the right cup 30. It should be understood that the configuration of the first strap 121 and the second fastener portion 123 can be reversed, wherein the second fastener portion 123 is coupled to the right wing 70 and the first end 121*a* of the first strap 121 is coupled to the lower band 50 or the right cup 30. Also, second fastener portion 123 could comprise a loop through which the second end 121*b* of the first strap 121 is inserted, and then the second end 121*b* is then brought back over the first end 121*a* of the first strap 121 to fasten onto itself (e.g., as with mating hook/loop material). As will be understood, the type of first strap 121 and the type and location of the mating structures thereon will have input into how, and how much, adjustment of the first strap 121 is achieved. As but one example, a longer first strap 121 having a longer section of hook/loop material thereon will provide more adjustment (length and compression) to the first strap 121 than would a shorter first strap 121 and/or a shorter section of hook/loop material thereon.

Also, it should be understood that the first strap 121 and its adjustability can assume other structures as well. As one example, the first strap 121 can be of a type similar to that of typical bra straps (e.g., right strap 100) and can have a length adjuster similar to adjuster 103 that provides a user with the ability to adjust the length of the first strap 121, and therefore also the amount of tension in the first strap 121, which adjusts the amount of compression applied to the right breast. For such embodiment, the first end 121*a* and second end 121*b* would be fastened (typically, sewn) into the garment 10 in locations as described above. The user would increase the compression applied to the right breast by shortening the length of the first strap 121, and would decrease the compression applied to the left breast by lengthening the first strap 121. The first strap 121 can be on the exterior of the garment 10 (as shown in the figures) or can be located on an interior of the garment 10 so as to be less visible when the garment 10 is worn underneath clothes. In such interior arrangements, the first strap 121 can, for example, be fitted inside a sleeve sewn on the inside of the right cup 30, right wing 70, center panel 40, etc. The first fastener portion 122 and second fastener portion 123 would obviously be modified according to this physical arrangement such that the user can adjust the tension in the first strap 121 by fastening to an interior surface of the garment 10 rather than an exterior surface of the garment 10. Alternatively, the first strap 121 can still be situated on external surfaces of the garment 10 (as shown in the figures), but could be covered with additional material or sleeves or flaps so as to provide a smoother external appearance when the garment 10 is worn under other clothing. Alternatively, the first strap 121 can itself be padded or made from a padded material, as opposed to simply from an elastic material. Alternatively, in either external or internal locations, the first strap 121 can be in the form of a drawstring that is inserted into and anchored within a pocket within the garment 10. Such drawstring can be akin to commonly known drawstrings present in other garments, such as sweatpants, hooded sweatshirts, coats, and the like. The drawstring can be fitted with a stopper on an end thereof that can fasten to the drawstring at various locations therealong, thereby altering a length of the drawstring, and thus enabling a user to adjust the tension in the first strap.

With regard to the second strap 126, first end 126*a* is attached to the garment 10, preferably at the right wing 70. The first end 126*a* of the second strap 126 is coupled to the garment 10 between a right arm opening 12 (discussed below) and a bottom portion of right wing 70, preferably at or near a central region or mid-height thereof and preferably in a sagittal plane at or anteriorly to the coronal (frontal) midline of the user when the garment 10 is worn. Second end 121*b* is a free end that includes a first fastener portion 127 thereon. First fastener portion 127 is configured to adjustably engage with a second fastener portion 128 that is coupled to a different location on the garment 10. Preferably, the second fastener portion 128 is coupled at or proximate to the upper, cephalad region 36 of the right cup 30 or the right strap 100. It should be understood that the configuration of the second strap 126 and the second fastener portion 128 can be reversed, wherein the second fastener portion 128 is coupled to the right wing 70 and the first end 126*a* of the second strap 126 is coupled to the right strap 100 or the right cup 30. Also, second fastener portion 128 could comprise a loop through which the second end 126*b* of the second strap 126 is inserted, and then the second end 126*b* is then brought back over the first end 126*a* of the second strap 126 to fasten onto itself (e.g., as with mating hook/loop material). And, as discussed above with regard to first strap 121, the type of second strap 126 and the type and location of the mating structures thereon will have input into how, and how much, adjustment of the second strap 126 is achieved. As but one example, a longer second strap 126 having a longer section of hook/loop material thereon will provide more adjustment (length and compression) to the second strap 126 than would a shorter second strap 126 and/or a shorter section of hook/loop material thereon.

Also, it should be understood that the second strap 126 and its adjustability can assume other structures as well. As one example, the second strap 126 can be of a type similar to that of typical bra straps (e.g., right strap 100) and can have a length adjuster similar to adjuster 103 that provides a user with the ability to adjust the length of the second strap 126, and therefore also the amount of tension in the second strap 126, which adjusts the amount of compression applied to the right breast. For such embodiment, the first end 126*a* and second end 126*b* would be fastened (typically, sewn) into the garment 10 in locations as described above. The user would increase the compression applied to the right breast by shortening the length of the second strap 126, and would decrease the compression applied to the left breast by lengthening the second strap 126. The second strap 126 can be on the exterior of the garment 10 (as shown in the figures) or can be located on an interior of the garment 10 so as to be less visible when the garment 10 is worn underneath clothes. In such interior arrangements, the second strap 126 can, for example, be fitted inside a sleeve sewn on the inside of the right cup 30, right wing 70, etc. The first fastener portion 127 and second fastener portion 128 would obviously be modified according to this physical arrangement such that the user can adjust the tension in the second strap 126 by fastening to an interior surface of the garment 10 rather than an exterior surface of the garment 10. Alternatively, the second strap 126 can still be situated on external surfaces of the garment 10 (as shown in the figures), but could be covered with additional material or sleeves or flaps so as to provide a smoother external appearance when the garment 10 is worn under other clothing. Alternatively, the second strap 126 can itself be padded or made from a padded material, as opposed to simply from an elastic material. Alternatively, in either external or internal locations, the second strap 126 can be in the form of a drawstring that is inserted into and anchored within a pocket within the garment 10. Such drawstring can be akin to commonly known drawstrings present in other garments, such as sweatpants, hooded sweatshirts, coats, and the like. The drawstring can be fitted with a stopper on an end thereof that can fasten to the drawstring at various locations therealong, thereby altering a length of the drawstring, and thus enabling a user to adjust the tension in the second strap.

In this configuration of the second medial compressor 120, the first strap 121 and second strap 126 can be used and adjusted to apply targeted, localized compression along each of their lengths, respectively, to provide an enveloping "cupping" support for the right breast. This cupping support serves to not only retain the right breast in position, but also to provide a component of a medial force on the right breast, a partially cephalad force on the lower side of the right breast, and a partially caudal force on the upper side of the right breast. In doing so, the first strap 121 and second strap 126 serve to "push" the right breast medially or partially medially, and in some cases anteriorly and maintain the implant properly in the breast cavity or capsule for proper healing. For example, the first strap 121 can apply a compression force to the right breast in a medial-cephalad direction and such compression can be adjusted by adjusting the length or tension in the first strap 121 by moving the first fastener portion 122 relative to the second fastener portion 123. For example, the first strap 121 can be an elastic material, with first end 121*a* sewn at or near the right wing 70. The first end 121*a* can be at the coronal midline or anteriorly of it, and is shown anteriorly in the figures. The second end 121*b* has a first fastener portion 122 that matingly couples with the second fastener portion 123. The fastener portions can be any of a number of commonly used fasteners for garments such as garment 10, wherein one fastener portion (either 122 or 123) comprises a first component of a fastener, and the other portion (either 123 or 122) comprises the mating partner of the first component. Some examples include, but are not limited to, hook and eye, hook and loop, figure-8 type clasps, non-slip adjustable bra clips, mating rings, magnets, buttons/holes, snaps, various slides, and the like. The length of the first strap 121 and second strap 126, the amount of elasticity in the straps, the relative size, number, and position of the first fastener portions 122, 127 and second fastener portions 123, 128 all can contribute to the ability for a user to adjust the amount of tension in the first strap 121 and second strap 126, respectively, which in turn relates to the amount and direction of targeted, localized compression applied to the breast when the garment 10 is worn. This compression can manifest in actual movement of the breast in a medial and/or medial-cephalad direction, or in increased stress applied to the breast with or without noticeable movement of the breast.

FIG. 6C shows a second embodiment of second medial compressor 120. In this embodiment, only first strap 121 is present. This embodiment might be useful for a person who either does not want or does not need the type of force applied by, and the resulting motion of the breast from, the second strap 126.

The materials that can make up the various components of the garment 10 are many. Indeed, many of the components of the garment 10 have design goals that make some materials more preferable for those components than perhaps for other components of the garment 10. However, this is not intended to limit the garment 10 to any particular material for any particular component. Furthermore, the materials specifically mentioned herein are themselves not intended to limit the materials useful for the various components, it being understood that a very large variety of materials are useful and garments that can serve the purposes of the garment 10. As an example, most of the materials described for one component (e.g., the rear panel 80) can also be used for another component (e.g., center panel 40, left wing 60, right wing 60, left cup 20, or right cup 30). The following discussion is intended only to provide some examples of materials that might be used.

The cups 20, 30 can be made from any soft and pliable material that is comfortable to house the breasts. Non-limiting examples include cotton; cotton blends; wool; wool blends; silk; satin; charmeuse; elastomeric synthetic filament materials, such as elastanes like spandex and its similar materials sold by the LYCRA Company under the trademark LYCRA®, etc.; non-stretch knits, such as duoplex; nylon; various tree-based fabrics, such as bamboo, modal, etc.; polyesters; Tricot, spanette, latex, microfiber, jacquard, mesh, lace, polyester, nylon and all sorts of blends of these, as well as other materials with similar properties. Some more specific examples include blends of 78% nylon/22% elastane; 87% nylon/13% spandex; 94% rayon/6% spandex; 85% nylon/15% spandex; 95% cotton/5% spandex; 71% polyamide/29% elastane; and all blends within any of the ranges set forth herein. Further, the cups 20, 30 can be molded cups of 100% polyester.

Various components discussed herein can also include lining for various purposes, including to provide some level of sturdiness or support, moisture control, breathability, comfort, and the like. Non-limiting examples of materials that can be used for the linings of the garment 10 include all of the above materials, as well as nylon (in various deniers); stretch mesh (e.g., nylon/spandex blend); polyester and polyester blends; natural rubbers; blends with natural rubbers; and the like, including all blends within any of the ranges set forth herein.

The center panel 40 and the wings 60, 70, and the rear panel 80 can also be made of any of the aforementioned materials. Various materials may serve as better choices for these components, depending on the desired level of elasticity and support needed. More specific examples include blends of 76% nylon/24% elastane; 80% nylon/20% spandex; 87% nylon/13% spandex; 92% nylon/8% spandex; 65% nylon/28% polyester/7% spandex, including all blends within any of the ranges set forth herein.

The various pads, whether in the cups 20, 30 or in the wings 60, 70 can be made of many materials, as discussed. Non-limiting examples include various types and densities of polyurethane (PE) foams. In addition, other thermoplastic polymeric materials are possible, including, but not limited to ethylene-vinyl acetate (EVA) foam; low-density polyethylene (LDPE) foam; nitrile rubber (NBR) foam; copolymers of acrylonitrile (ACN) and butadiene; polychloroprene foam (such as Neoprene); polyimide foam; polypropylene (PP) foam; polystyrene (PS) foam; polyurethane (PU) foams (including memory foams); polyuria foam; polyvinyl chloride (PVC) foam; any commonly known open-cell foams or plastics; any commonly known closed-cell foams or plastics; silicone foams; natural rubbers; natural sponge; silicon gels; other gels; polyesters; and the like; and any of the materials and blends set forth herein. The various pads can also be non-foam materials, such as one or more layers of fabric that, when layered, provides a thicker material that can be compressed upon the application of force.

The various bands, such as lower band 50, can also employ many different materials, including any of the materials and blends discussed herein. Perhaps more than other components, the lower band 50 and other components that are desired to be elastic might use materials that have or provide higher levels of elasticity. Elasticity is a material's propensity to regain its original shape after the force causing the elastic deformation has been removed. Any of the aforementioned materials that provide elasticity can be used for the lower band 50, it being understood that some embodiments utilize materials with high levels of elasticity for certain components. In addition to that set forth above, additional specific examples include blends of 58% nylon/26% polyester/16% spandex; 68% polyester/32% rubber; and the like.

The left strap 90 and right strap 100 are typically made from materials that provide adequate support from the garment 10 in holding the breasts within the garment 10. Some straps can be made from elastic materials, such as those described above, where some level of stretch or elastic deformation is desired. Other straps can be made from less elastic materials, where elasticity is not desired. In addition to the materials set forth herein, additional examples of materials for the straps 90, 100 include blends of 88% nylon/12% elastane; 50% polyester/50% rubber; 70% polyester/30% rubber; and the like. The adjusters 93, 103 of the straps are made from commonly used materials for bras. These materials include, but are not limited to, metals, metal alloys (including stainless steel), composites, and various plastics. Similarly, the materials used for the closure mechanism 47 can also utilize these materials as well, in addition to all commonly known materials for the particular type of closure mechanism 47 being used. As an example, where the closure mechanism 47 happens to be a hook and loop fastener, all materials commonly used for hook and loop fasteners for garments are likely to be used. Where the item is a closure mechanism (e.g., a hook and eye closure for the bra itself), all materials commonly used for bra closures (e.g., various metals, alloys, plastics, resins, composites, and the like) are likely to be used.

For garments 10 that include underwires and/or boning 130, these components can also be made from a variety of materials. Such materials are typically desired to be lightweight and strong and relatively inelastic. In addition to the materials discussed herein, non-limiting examples include metals, metal alloys (including stainless steel), composites, and various plastics. For the thread used in the garment 10, any commonly used thread for such garments is contemplated, including, without limitation, polyester, rayon, cotton-covered polyester, and the like.

Methods

A user who desires a garment that can provide targeted, localized compression can choose to wear garment 10. Such a user might be, as discussed, a person who has undergone some form of breast surgery. However, such a user might also be a woman who has not undergone breast surgery, but rather simply desires a garment that can provide targeted, localized compression to her breasts and the concomitant movement and/or shaping that results. As discussed above, in providing the targeted, localized compression, the garment 10 also results in some lifting and pushing effects on the breasts, which can provide a pleasing appearance to the breasts that is desirable. For case of description, a method of using the garment 10 will be described with reference to an embodiment of the garment 10 that has a closure mechanism 47 on a center panel 40.

The user selects the garment 10. If the garment 10 is a non-opening garment, the user slips the garment 10 over her head and inserts her arms into the appropriate arm openings. If the garment 10 is an opening garment, the user ensures that the closure mechanism 47 is released such that the garment 10 is in an open receiving orientation, such as, e.g., shown in FIG. 10. The user inserts one arm (e.g., her left arm or her right arm) into the appropriate arm opening (e.g., either the left arm opening 11 or the right arm opening 12) such that the left cup 20 and right cup 30 are in front of the user's left breast and right breast, respectively. The user can close the garment 10 around her breasts by fastening the components of the closure mechanism 47. If the garment 10 closes in the back, the user (or an assistant) fastens the closure mechanism 47 in the rear. If the garment 10 is a front close garment, the user (or, if needed, an assistant) fastens the closure mechanism 47 at the front. At this step, the user's left breast now resides within the left cup 20, and the user's right breast resides within the right cup 30. If needed, the user can make adjustments to either or both of the left strap 90 and/or right strap 100, by manipulating the adjuster 93 and/or the adjuster 103 on the relevant strap 90, 100 to provide the desired length and, therefore, fit of the left strap 90 and right strap 100.

If the user desires to provide targeted, localized compression to her breasts in embodiments having one or more pads

65, 75, a further step involves deciding on the desired shape and size of the pad 65 for the left wing 60 and of the pad 75 for the right wing 70. Once the desired pad 65, 75 has been selected, the user inserts the pad 65 through pocket opening 64 and into the pocket 63. This insertion step can occur before or after the user places the garment 10 on the user's body. The user can manipulate the pad 65 inside the pocket 63 to achieve the desired location for the pad 65 and the desired fit. Similarly, the user can manipulate the pad 75 inside the pocket 73 to achieve the desired location for the pad 75 and the desired fit. Once the pads 65, 75 are in their respective pockets 63, 73, the pads 65, 75 convert the overall compression of the garment 10 (e.g., via the elasticity of the lower band 50 and/or of the left cup 20, right cup 30, left wing 60, right wing 70, and/or rear panel 80) into a targeted, localized compression on the breasts. Specifically, the pad 65 imparts a force on the left breast in a primarily medial direction, due to the added thickness of the pad 65 and its targeted location at the lateral or lateral-caudal surface of the left breast. And, the pad 75 imparts a force on the right breast (i.e., adds targeted compression) in a primarily medial direction, due to the added thickness of the pad 75 and its targeted location as discussed herein at the lateral or lateral-caudal surface of the right breast when located as discussed herein to help keep the implant properly in the breast cavity or capsule for proper healing.

Additionally or alternatively, in garments including them, another step can involve adjusting first medial compressor 110 and second medial compressor 120. To provide additional medial compression to the caudal side of the user's left breast, the user can adjust the first strap 111 in such a way as to shorten the first strap 111 or otherwise tighten the first strap 111. This can be done in various ways depending on the type of first fastener mechanism 112 and second fastener mechanism 113 as discussed above. One example can involve bringing first end 111*a* or second end 111*b* into contact with left wing 60 or lower band 50, respectively, so as to shorten the first strap 111. Another example can involve looping second end 111*b* through a loop and bringing second end 111*b* back onto the first strap 111 near the first end 111*a*.

Additionally or alternatively, in garments having such features, the user can also provide additional medial compression to the cephalad side of the user's left breast by adjusting the second strap 116 in such a way as to shorten the second strap 116 or otherwise tighten the second strap 116. This can be done in various ways depending on the type of first fastener mechanism 117 and second fastener mechanism 118 as discussed above. One example can involve bringing first end 116*a* or second end 116*b* into contact with left wing 60 or left cup 20, respectively, so as to shorten the second strap 116. Another example can involve looping second end 116*b* through a loop and bringing second end 116*b* back onto the second strap 116 near the first end 116*a*.

Similarly, to provide additional medial compression to the caudal side of the user's right breast, the user can adjust the first strap 121 in such a way as to shorten the first strap 121 or otherwise tighten the first strap 121. This can be done in various ways depending on the type of first fastener mechanism 122 and second fastener mechanism 123 as discussed above. One example can involve bringing first end 121*a* or second end 121*b* into contact with right wing 70 or lower band 50, respectively, so as to shorten the first strap 121. Another example can involve looping second end 121*b* through a loop and bringing second end 121*b* back onto the first strap 121 near the first end 121*a*.

Additionally or alternatively, in garments having such features, the user can also provide additional medial compression to the cephalad side of the user's right breast by adjusting the second strap 126 in such a way as to shorten the second strap 126 or otherwise tighten the second strap 126. This can be done in various ways depending on the type of first fastener mechanism 127 and second fastener mechanism 128 as discussed above. One example can involve bringing first end 126*a* or second end 126*b* into contact with right wing 70 or right cup 30, respectively, so as to shorten the second strap 126. Another example can involve looping second end 126*b* through a loop and bringing second end 126*b* back onto the second strap 126 near the first end 126*a*.

By adjusting the first medial compressor 110 and the second medial compressor 120, the user adds additional medial and/or medial-caudal and/or medial-cephalad compression to each of her breasts. This targeted, localized compression provides the medial support required to not only keep the breast tissue and/or implants in proper place for healing, but also provides a "push" in the medial and/or medial-cephalad direction, and in some cases in the anterior direction, which provides an enhanced appearance to the breasts.

In embodiments of the garment 10 that include both pockets 63, 73 as well as first medial compressor 110 and second medial compressor 120, the steps involved in applying localized, targeted compression to the breasts obviously include a combination of the above steps used for each separate aspect of compression-providing means. As discussed, the pads 65, 75 can be inserted into the garment 10 either before or after the user places the garment 10 on her torso. And, of course, in garments that include pads 65, 75 that are already sewn into the garment 10, there is no need to include the specific step of adding a pad 65, 75.

Where a user desires to add localized, targeted compression to her breasts using her own garment of choice (i.e., not obtaining garment 10), the user can simply obtain a sleeve 140 and a desired pad 65, 75. The user can adhere a sleeve 140 within the left lateral side of her garment of choice, and, if desired, adhere a sleeve 140 within the right lateral side of her garment of choice with a coupling device 145. The location for one end of the sleeves 140 is as discussed herein with respect to the pockets 63, 73 and pads 65, 75, in the ranges described. For example, one end of the sleeve can be located at a point between approximately the coronal plane midline axis and a point that is approximately 6 cm anterior of said axis. The location for the other end of the sleeves 140 is a point that ranges from slightly more anterior than the location of the base of the breast cavity; and a point that is approximately 60 percent of the distance of the breast projection. The methods of adhering the sleeve 140 to the garment include all those discussed herein, and in particular can include sewing or adhering one half of the coupling device 145 via adhesive to the inside surface of the garment at the desired location for retaining the implant within the capsule or the breast within the breast cavity. The user couples the other half of the coupling device 145 to the sleeve 140 at the desired location(s). The user selects a pad 65 and inserts it into the left sleeve 140, and selects a pad 75 and inserts it into the right sleeve 140. The selection and insertion steps can occur before or after the step of adhering the sleeves 140 to the garment. After the pads 65, 75 are inserted into the sleeves 140, and the sleeves 140 are adhered to the inside of the garment, the user can put on the garment in typical fashion. Once the garment is on the user, the sleeves 140, with pads 65, 75 therewithin, respectively, the pads 65, 75 provide localized, targeted compression at the appropriate locations on the user to keep the user's breast in the breast cavity or the implant in the capsule, as discussed.

While several embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the teachings is/are used. Those skilled in the art will recognize, or be able to ascertain using no more than routine experimentation, many equivalents to the specific embodiments described herein. It is, therefore, to be understood that the foregoing embodiments are presented by way of example only and that, within the scope of the appended claims and equivalents thereto, embodiments may be practiced otherwise than as specifically described and claimed. Embodiments of the present disclosure are directed to each individual feature, system, article, material, and/or method described herein. In addition, any combination of two or more such features, systems, articles, materials, and/or methods, if such features, systems, articles, materials, and/or methods are not mutually inconsistent, is included within the scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively.

It is to be understood that the embodiments are not limited in its application to the details of construction and the arrangement of components set forth in the description or illustrated in the drawings. The invention is capable of other embodiments and of being practiced or of being carried out in various ways. Unless limited otherwise, the terms "connected," "coupled," "in communication with," and "mounted," and variations thereof herein are used broadly and encompass direct and indirect connections, couplings, and mountings. In addition, the terms "connected" and "coupled" and variations thereof are not restricted to physical or mechanical connections or couplings.

The foregoing description of several embodiments of the invention has been presented for purposes of illustration. It is not intended to be exhaustive or to limit the invention to the precise structure, steps, and/or forms disclosed, and obviously many modifications and variations are possible in light of the above teaching.

What is claimed is:

1. A support garment comprising:

a left cup configured to receive a left breast when said support garment is worn by a user, said left cup having a base and a left cup length projection;

a right cup configured to receive a right breast when said support garment is worn by a user, said right cup having a base and a right cup length projection;

a rear panel;

a left wing connecting said left cup to said rear panel, said left wing having a pocket therein, said pocket including a pocket opening configured to receive therethrough a pad; and a right wing connecting said right cup to said rear panel, said right wing having a pocket therein, said pocket including a pocket opening configured to receive therethrough a pad, wherein:

at least one of the pocket of the left wing or the pocket of the right wing is located between a midline axis of said support garment and a point that is anteriorly spaced from said midline axis a distance equal to approximately 60 percent of the left cup length projection or the right cup length projection, respectively; and at least one of the pad received in the pocket of the left wing or the pad received in the pocket of the right wing is substantially planar with a relatively constant thickness and having an overall shape selected from the group consisting of polygonal, circular, oval, cupped, and anatomically curved, and such that said overall shape further comprises a cutout on an end of the respective pad.

2. The support garment of claim 1 wherein a first end of said at least one of the pad received in the pocket of the left wing or the pad received in the pocket of the right wing is located between said midline axis and a point that is approximately 6 cm anteriorly spaced from said midline axis.

3. The support garment of claim 2 wherein a second end of said pocket of said at least one of the pad received in the pocket of the left wing or the pad received in the pocket of the right wing is located between said base of said left cup or said base of said right cup, respectively, and a point that is anteriorly spaced from said midline axis a distance equal to approximately 60% of the left cup length projection.

4. The support garment of claim 1, wherein said at least one of the pad received in the pocket of the left wing or the pad received in the pocket of the right wing is configured to impart a targeted, localized compression force having a medial component thereof to the left breast or the right breast, respectively, of a user when said support garment is worn by the user.

5. The support garment of claim 1 further comprising a closure mechanism configured to alternately connect and disconnect two portions of said support garment.

6. The support garment of claim 5 wherein said closure mechanism is located at said rear panel.

7. The support garment of claim 1 further comprising a center panel connecting said left cup to said right cup.

8. The support garment of claim 7 further comprising a closure mechanism located at said center panel.

9. The support garment of claim 1 further comprising a lower band connecting said left wing, said right wing, and said rear panel.

10. A support garment comprising:

a left cup configured to receive a left breast when said support garment is worn by a user, said left cup having a left cup length projection;

a right cup configured to receive a right breast when said support garment is worn by a user, said right cup having a right cup length projection;

a center panel further comprising a first portion and a second portion, wherein said first portion includes a first closure mechanism portion thereon and wherein said second portion includes a second closure mechanism portion thereon configured to mate with said first closure mechanism portion and to thereby selectively couple and decouple said second portion to said first portion;

a rear panel;

a left wing connecting said left cup to said rear panel;

a left strap connecting said left cup to said rear panel and spaced away from said left wing in a cephalad direction to create a first arm hole therebetween;

a right wing connecting said right cup to said rear panel; and a right strap connecting said right cup to said rear panel and spaced away from said right wing in a cephalad direction to create a second arm hole therebetween, wherein:

said left wing further comprises a pocket therein located between a midline axis of said support garment and a point that is anteriorly spaced from said midline axis a distance equal to approximately 60 percent of the left cup length projection, said pocket including a pocket opening configured to receive therethrough a pad;

said right wing further comprises a pocket therein located between a midline of said support garment and a point that is anteriorly spaced from said midline axis a distance equal to approximately 60 percent of the right cup length projection, said pocket including a pocket opening configured to receive therethrough a pad; and at least one of the pad received in the pocket of the left wing or the pad received in the pocket of the right wing is substantially planar with a relatively constant thickness and having an overall shape selected from the group consisting of polygonal, circular, oval, cupped, and anatomically curved, and such that said overall shape further comprises a cutout on an end of the respective pad.

11. The support garment of claim 10, wherein said at least one of the pad received in the pocket of the left wing or the pad received in the pocket of the right wing is configured to impart a targeted, localized compression force having a medial component thereof to the left breast of a user when said support garment is worn by the user.

12. A method of supporting a breast within a garment, comprising the steps of:

providing a garment having a left cup configured to receive a left breast of a user, a right cup configured to receive a right breast of a user, a rear panel, a left wing connecting said left cup to said rear panel, and a right wing connecting said right cup to said rear panel; wherein said left wing further comprises a left wing pocket therein configured to receive a pad through a left wing pocket opening, and wherein said right wing further comprises a right wing pocket therein configured to receive a pad through a right wing pocket opening;

selecting a first pad, wherein said first pad is substantially planar with a relatively constant thickness and having an overall shape selected from the group consisting of polygonal, circular, oval, cup-shaped, anatomically curved, and wherein said overall shape further comprises a cutout on an end of said pad;

inserting said first pad through said left wing pocket opening into said left wing pocket; and placing said support garment on a user's body in a manner such that the user's left breast is received in said left cup; the user's right breast is received in said right cup; and said first pad is located on a lateral side of the user's left breast between a midline axis of said support garment and a point that is anteriorly spaced from said midline axis a distance equal to approximately 60 percent of a left cup length projection.

13. The method of supporting a breast within a garment according to claim 12, further comprising the steps of:

selecting a second pad; and inserting said second pad through said right wing pocket opening into said right wing pocket.

14. The method of supporting a breast within a garment according to claim 13, wherein the placing step further comprises:

placing said support garment on a user's body in a manner such that said second pad is located on a lateral side of the user's right breast between said midline axis of said support garment and a point that is anteriorly spaced from said midline axis a distance equal to approximately 60 percent of a right cup length projection.

* * * * *